United States Patent [19]

Nino

[11] Patent Number: 5,055,981

[45] **Date of Patent: * Oct. 8, 1991**

[54] AUTOMOTIVE PROJECTOR TYPE HEADLIGHT

[75] Inventor: Naohi Nino, Shimizu, Japan

[73] Assignee: Koito Manufacturing Co., Ltd., Tokyo, Japan

[ * ] Notice: The portion of the term of this patent subsequent to Apr. 3, 2007 has been disclaimed.

[21] Appl. No.: 481,100

[22] Filed: Feb. 16, 1990

[30] Foreign Application Priority Data

Feb. 17, 1989 [JP] Japan ..... 1-37731
Feb. 17, 1989 [JP] Japan ..... 1-37732
Feb. 20, 1989 [JP] Japan ..... 1-39525

[51] Int. Cl.[5] ..... F21M 3/08; F21M 3/14; F21V 7/09

[52] U.S. Cl. ..... 362/61; 362/297; 362/308

[58] Field of Search ..... 362/61, 297, 346, 351, 362/307, 308

[56] References Cited

U.S. PATENT DOCUMENTS 4,686,610 8/1987 Cibié et al. ..... 362/351
4,704,661 11/1987 Kosmatka ..... 362/61
4,772,987 9/1988 Kretschmer et al. .
4,827,214 5/1990 Oyama ..... 362/61
4,851,968 7/1989 Nino .
4,885,669 12/1989 Nino .
4,914,747 3/1990 Nino ..... 362/61
4,922,389 5/1990 Nino .
4,953,063 8/1990 Nino ..... 362/61

*Primary Examiner*—Ira S. Lazarus
*Assistant Examiner*—Richard R. Cole
*Attorney, Agent, or Firm*—Sughrue, Mion, Zinn, Macpeak & Seas

[57] ABSTRACT

An automotive projector type headlight including a light source, a reflector for reflecting the light forward, a shade for partially shading and thus contouring the reflected light, and a projecting lens for projecting the contoured light forward. The light source comprises a main filament and a sub-filament extending generally along the optical axis. The reflector has a plurality of radially divided reflective surface portions. An upper reflective surface portion reflects the light from the sub-filament and converge it to a first converging position located above the optical axis. A shading edge of the shade is positioned near to the first converging position. The projecting lens has a focus near to the shading edge. A lower reflective surface portion reflects the light from the main filament, converges it to a second converging position extending horizontally and converges the light to a third converging position extending vertically. Left and right reflective surface portions act to converge the light from both filaments and to diffuse it thereafter. And a portion of the reflective surface is formed into paraboloid of rotation having the focus near to the filaments.

11 Claims, 35 Drawing Sheets

AUTOMOTIVE PROJECTOR TYPE HEADLIGHT

FIELD OF THE INVENTION

The present invention relates to automotive headlights and, more particularly to automotive headlights of a so-called projector type which includes an electric lamp for generating light, a reflector for reflecting the light forward, a shade placed in front of the reflector for partially shading and thus contouring the reflected light, and a converging lens placed in front of the shade for projecting a contoured light beam forward.

DESCRIPTION OF PRIOR ART

In a prior art automotive projector type headlight, as typically shown in FIG. 31, the headlight a comprises a light reflector b having an ellipsoidal light reflecting surface formed on an inside surface thereof, a light source located near to a first focus $F_1$ of the light reflecting surface of the reflector b, a shade plate d located at a second focus $F_8$ of the reflecting surface of the reflector b, and a converging lens c located in front of the shade plate d with a focus of the lens c being located near to the upper edge of the shade plate d. The reflector b and the converging lens c are arranged coaxially along line x—x. When the light source is energized to light, the light rays emitted therefrom are reflected forward by the reflector b and converged at the second focus $F_2$ of the reflector b and, due to the presence of the shade plate d, part of the reflected light rays is shaded. Thus, the light beam projected forward from the converging lens c has a contoured pattern j such as shown in FIG. 32.

Such projector type headlight is advantageous in that the cut off ratio or the contrast ratio between the bright zone (the zone surrounded by solid line j in FIG. 32) and the dark zone (the zone outside of the line j) is high, that the size of the headlight can be reduced since the size is determined by that of the lens, that it is not required to provide steps on the lens for producing diffused light rays, that the outer lens may be inclined which is adapted as the headlight of modern automobiles, and the like.

However, there are drawbacks in such projector type headlight that it is not possible to provide two types of the light beam pattern such as a high beam and a lower beam from a single headlight. As is known the lower beam is the light beam intended for a forward neighbouring illumination particularly used when the vehicle is meeting or following other vehicles, and in usual headlight having a reflective mirror of paraboloid of rotation so that two types of light beam can be attained by providing two adjacent light sources at and near to the focus of the paraboloid. Thus, it is required to provide another headlight for producing exclusively the low beam, which compels that the vehicle has four headlights. Further, it is very difficult to change the brightness in the light beam pattern as desired. Such headlight has a circular shape with the diameter of 50–60 mm, but the circular projecting lens gives a singular design feature.

Further, as shown in FIGS. 32–35, there is a tendency that dark zones k and l in FIG. 32 and k' and l' in FIG. 33 will be observed adjacent to bright zones j and j' due to the fact that, as shown in FIG. 34, light rays g and g not reflected at the reflector are diffused by the projector lens. Particularly, when the projector type optical system is provided on the upper portion of a vehicle headlight as shown in FIG. 35, the length L is elongated and the light rays are not substantially directed directly to the projector lens, and the discrepancies are stressed.

FIGS. 36–38 show the projector type optical system provided on the upper portion of a vehicle headlight, in which, shown at X—X is the optical axis of the headlight being displaced downward from the optical axis of the projector lens c. The front edge d' of the shade plate d defines the contour of the upper edge of the light beam pattern j such as shown in FIG. 32. It will be understood that the pattern j is for the left side running vehicles. The focus $F_c$ of the projector lens c is located nearly on the edge d' of the shade plate d.

There is shortcomings that the light rays emitted from the light source a and directed to the reflector b is not fully utilized such that the light rays directed to the shaded portion b' of the reflector b are not reflected forward.

An object of the invention is to provide automotive projector type headlight overcoming above mentioned discrepancies.

SUMMARY OF THE INVENTION

According to the present invention, there is provided an automotive projector type headlight including a light source for generating light, a reflector for reflecting the light forward, a shade placed in front of the reflector for partially shading and thus contouring the reflected light, and a converging lens placed in front of the shade for projecting contoured light beam forward, wherein the light source comprises a main filament extending generally along an illuminating axis and a sub-filament disposed in front of the main filament, the reflector comprises a plurality of radially divided reflective surfaces as viewed in the front view, the upper side portions of the reflective surfaces are adapted to reflect the light rays from the sub-filament and to converge them to a first converging position located above the illuminating axis, the shade having a shading edge is positioned near to the first converging position, the converging lens is arranged to have a focus near to the shading edge, the lower side portions of the reflective surfaces are adapted to reflect the light rays from the main filament and to converge them to a second converging position located forward and extending horizontally and to converge them to a third converging position located forward of the second converging position and extending vertically, the portions of the reflective surfaces left and right sides and near to the center are adapted to converge the light rays from both of the filaments in the left and right directions and to diffuse thereafter, and the portions of the reflective surfaces outside and left and right sides have formed into paraboloid of rotation having the focus near to the filaments.

According to another feature of the invention, in the automotive projector type headlight of the type above mentioned, the shade plate is a generally horizontally disposed plate with the lower surface being formed as a reflective surface, and which reflective surface acts to reflect light rays received from the light source and from the reflector and to project them forward and downward.

According another feature of the invention, a portion of the reflector being located lower side of the shade plate as viewed in the front view is formed into a diffusing and reflecting surface for diffusing the light rays in the horizontal direction and and directing parallel to or slightly downward of the axis of illumination in the vertical directions.

The diffusing and reflecting surface may be a parabola in the vertical section and an ellipse in the horizontal section.

The diffusing and reflecting surface may be formed of left side and right side parabola shaped reflective surfaces, with the optical axes thereof being parallel to or inclining downward the axis of illumination.

BRIEF DESCRIPTION OF THE DRAWINGS

Further objects and effects of the invention will become apparent from the following detailed description in conjunction with the drawings, in which:

FIG. 13A shows a pattern of the high beam of the headlight of FIG. 1 before passing through a cover lens;

FIG. 13B shows a pattern of the high beam of the headlight of FIG. 1 after passing through a cover lens;

DETAILED DESCRIPTION OF PREFERRED EMBODIMENTS

First Embodiment (FIG. 1–FIG. 13)

Figure 1:
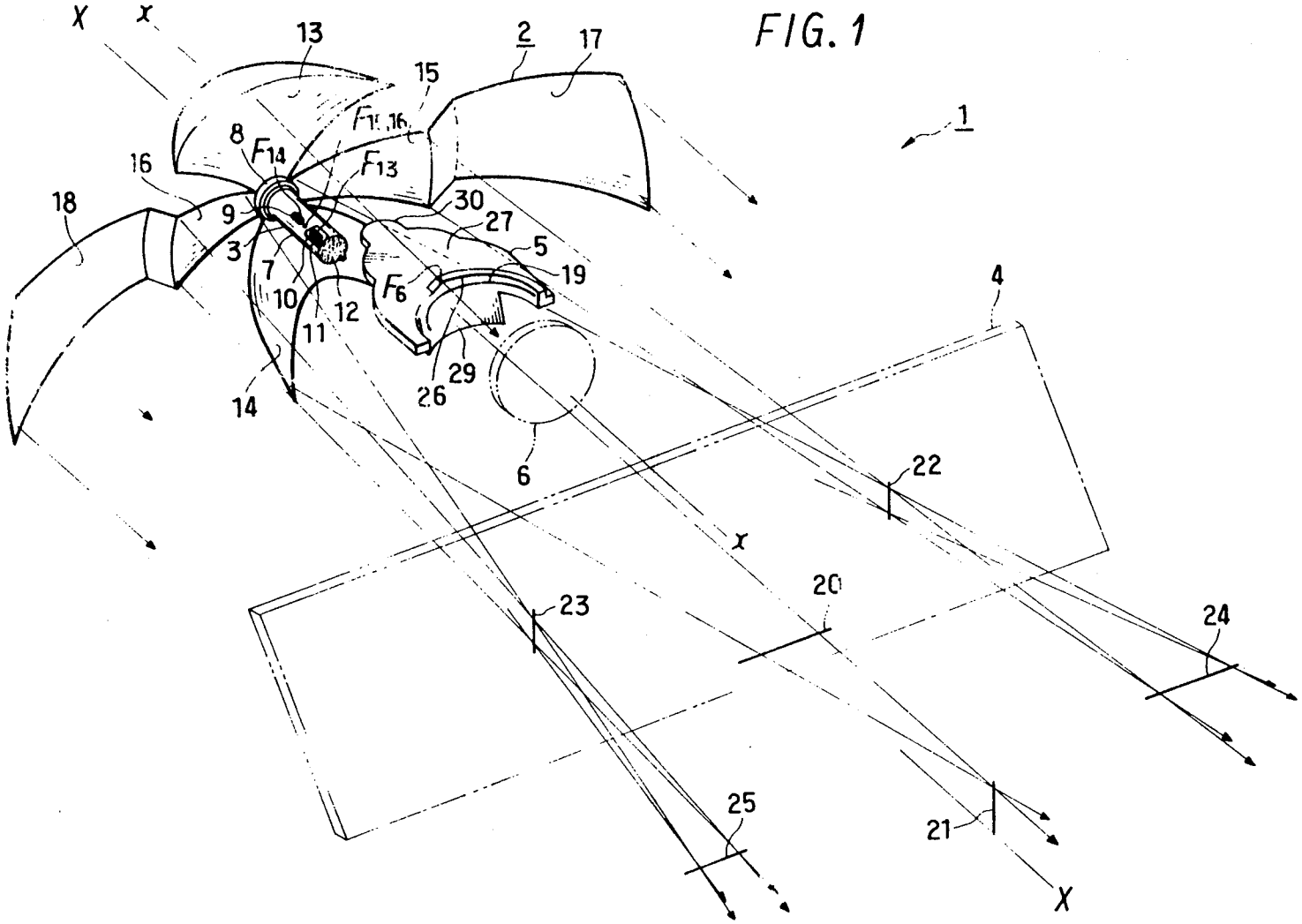
FIG. 1 is a schematic perspective view of an automotive projector type headlight according to a first embodiment of the present invention.

An automotive projector type headlight 1 according to the first embodiment of the present invention comprises a reflective mirror 2, a lamp bulb 3, a cover lens 4 in front of the reflector 2, a shade member 5 for making a cut off line on a light distribution pattern in the low beam, and a projector lens 6 for projecting forward the light rays being cut by the shade member 5.

Lamp Bulb

The lamp bulb 3 in the embodiment is of II4 type conforming the European Standard.

The lamp bulb 3 comprises a glass bulb 7, a base 8 mounted on the rear end of the glass bulb 7, two filaments 9 and 10 enclosed in the glass bulb 7, and a shade cap 11 covering generally the lower half of one filament 10. The front end portion of the glass bulb 7 is masked by masking paint 12. The two filaments 9 and 10 are respectively of coil like shape with the axis extending parallel to the axis of the glass bulb 7. The filament 10 is adapted to make the low beam and arranged in front of the filament 9 which makes the high beam.

The shade cap 11 covers the filament 10 against the nearly lower half of the reflective surface of the reflective mirror 2 which will hereinafter be explained in detail, thus, the light rays from the filament 10 are reflected by the upper half of the reflective surface and are projected forward.

The masking paint 12 on the front end of the glass bulb 7 intercepts the light rays from the filaments 9 and 10 against the forward direction.

Reflective Mirror

The reflective mirror 2 has a concave reflective surface facing forward, and the reflective surface are divided into a plurality of portions. The headlight 1 has an optical axis X—X being defined by a straight line passing through the center of the reflective mirror 2 and extending in the forward direction.

The reflective mirror 2 has a generally rectangular shape elongated in left and right directions and of reduced size in the vertical directions as viewed in the front view.

The reflective surface of the reflective mirror 2 is formed into four fan-shaped upper, lower, left inner and right inner reflective surface portions 13, 14, 15 and 16, and left outer and right outer reflective surface portions 17 and 18. It will be understood that the directions left and right are defined with respect to the forward direction.

Upper Reflective Surface Portion

Figure 3:
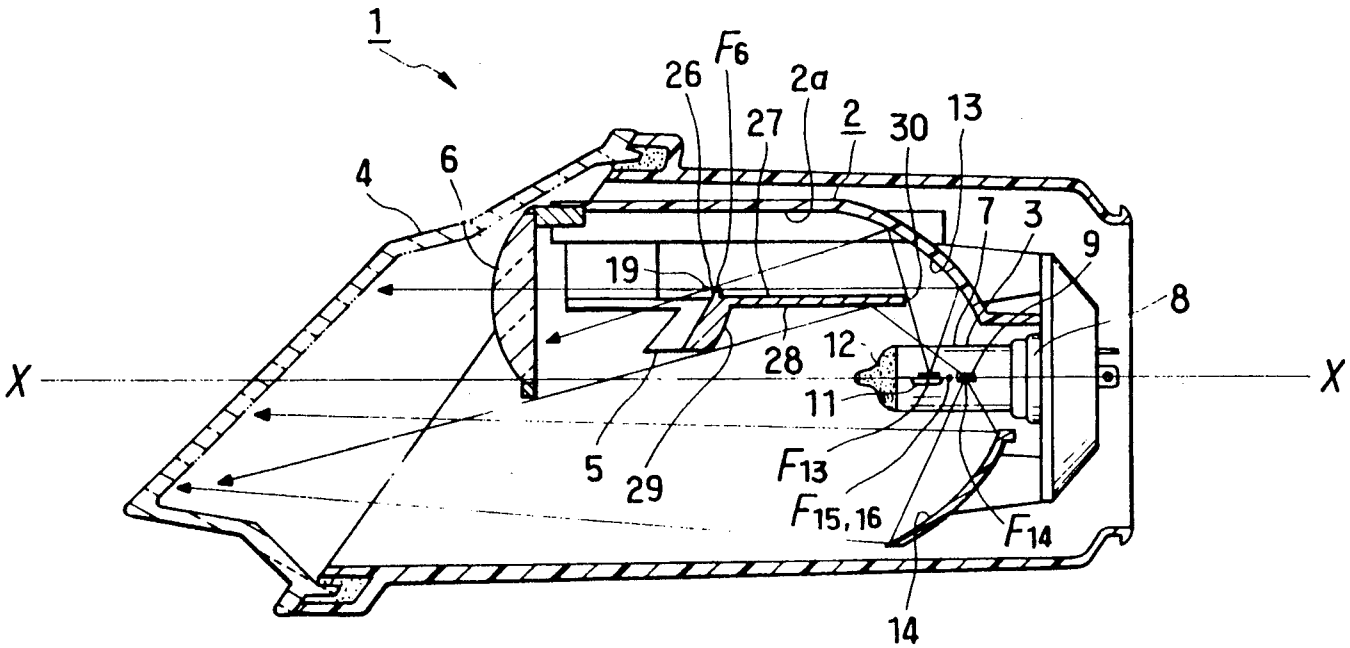
FIG. 3 is a section view taken along line III—III in FIG. 2.
Figure 4:
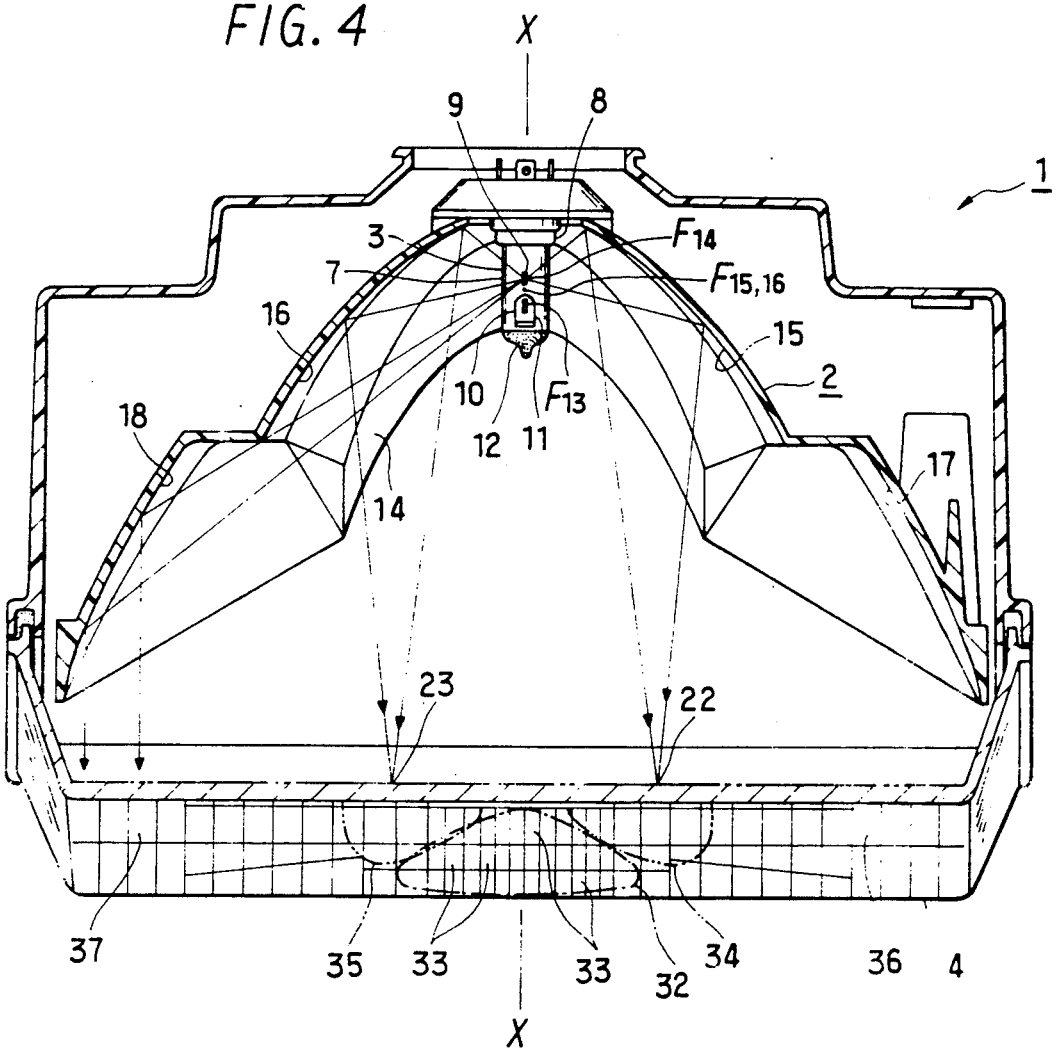
FIG. 4 is a section view taken along line IV—IV in FIG. 2.
Figure 5:
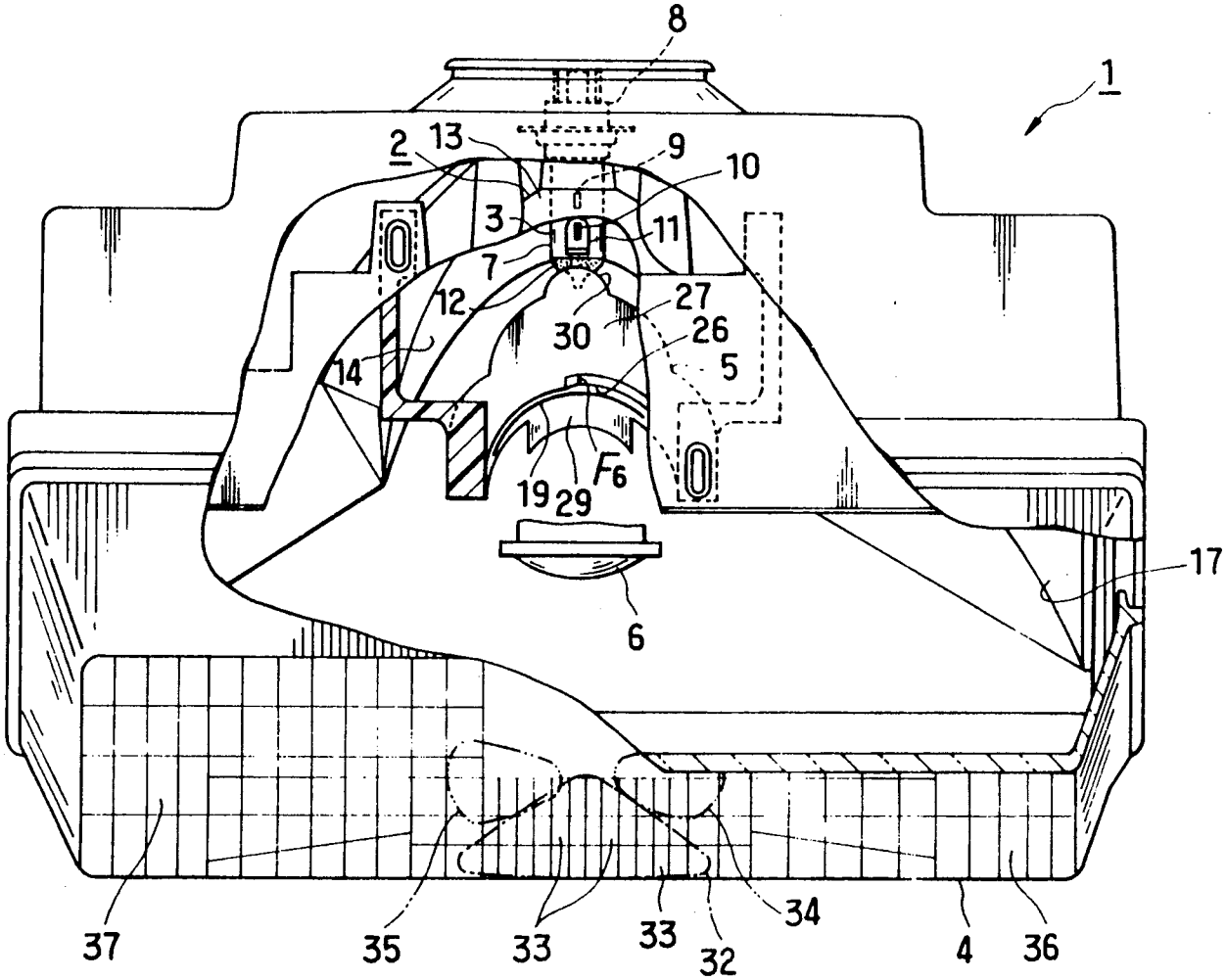
FIG. 5 is a partially broken plan view of the headlight of FIG. 1.

The upper reflective surface portion 13 defines a focus $F_{13}$ nearly on the axis X—X and a light converging position 19 above the axis X—X as shown in FIG. 3. In the embodiment, the position 19 generally horizontally extends and, in the plan view, is curved such that the opposite ends are positioned forward with respect to the central portion as shown in FIG. 5. The curvature is preferably conform with the curvature of image field of the projector lens 6.

One example of the reflective surface adapted for use as the surface portion 13 is shown in pending U.S. patent application Ser. No. 07/334,618 now U.S. Pat. No. 4,922,389.

Lower Reflective Surface Portion

The lower reflective surface portion 14 defines a focus $F_{14}$ nearly on the optical axis X—X and rearward of the focus $F_{13}$ of the upper reflective surface portion 13 and has a first converging position 20 of a horizontally extending straight line passing through the axis X—X and a second converging position 21 of a straight line which extends vertically and passing through the axis X—X at the location in front of the first converging position 20 as shown in FIG. 1.

Thus, when a light source is located on the focus $F_{14}$, the light rays emitted from the light source are reflected by the surface portion 14 and converge at the first converging position 20 and, thereafter, converge at the second converging position 21.

Such reflective surface is also disclosed in U.S. patent application Ser. No. 07/334,618 now U.S. Pat. No. 4,822,389, in which, parameters in the equation for determining the reflective surface should be determined suitably to define the first and second converging positions 20 and 21.

The Left and Right Inner Reflective Surfaces

The left and right inner reflective surface portions 15 and 16 define respectively focuses $F_{15}$ and $F_{16}$ nearly on the optical axis X—X, and define respectively first converging positions 22 and 23 of vertically extending straight lines and, second converging positions 24 and 25 of horizontally extending straight lines in front of respective first converging positions 22 and 23 as shown in FIG. 1. These reflective surfaces can also be obtained from the U.S. patent application Ser. No. 07/334,618 now U.S. Pat. No. 4,822,389.

The angle of diffusion of the light beam in left and right directions can be determined as desired by changing the size of the surfaces 15 and 16 and the position of the first converging positions 22 and 23. In particular, when the first converging positions 22 and 23 are located near to the reflective mirror 2 the angle of diffusion in left and right directions increases and, when the second converging positions 24 and 25 are located far from the reflective mirror 2 the light beam in the vertical directions approaches the parallel beam. The parallel beam in the vertical directions can be obtained from such as the reflective surfaces 7 and 8 in the first embodiment in Japanese Patent Application 199514/1988.

Further, the reflective surfaces shown in U.S. patent application Ser. No. 07/331,981 now U.S. Pat. No. 4,916,585 can be utilized as the reflective surfaces 15 and 16.

Left and Right Outer Reflective Surfaces

The left and right reflective surface portions 17 and 18 are respectively paraboloid of rotation, with the axis being nearly on the axis X—X, and the focuses being nearly at the focus $F_{14}$ of the lower reflective surface portion 14.

Position of the Light Source

The electric bulb 3 is arranged such that the center of the main filament 9 is located on the focus $F_{14}$ of the lower reflective surface portion 14 and the center of the sub-filament 10 is located on the focus $F_{13}$ of the upper reflective surface portion 13.

Shade Member

The shade member 5 has a generally plate like shape, and the front edge thereof constituting a shading edge.

Figure 7:
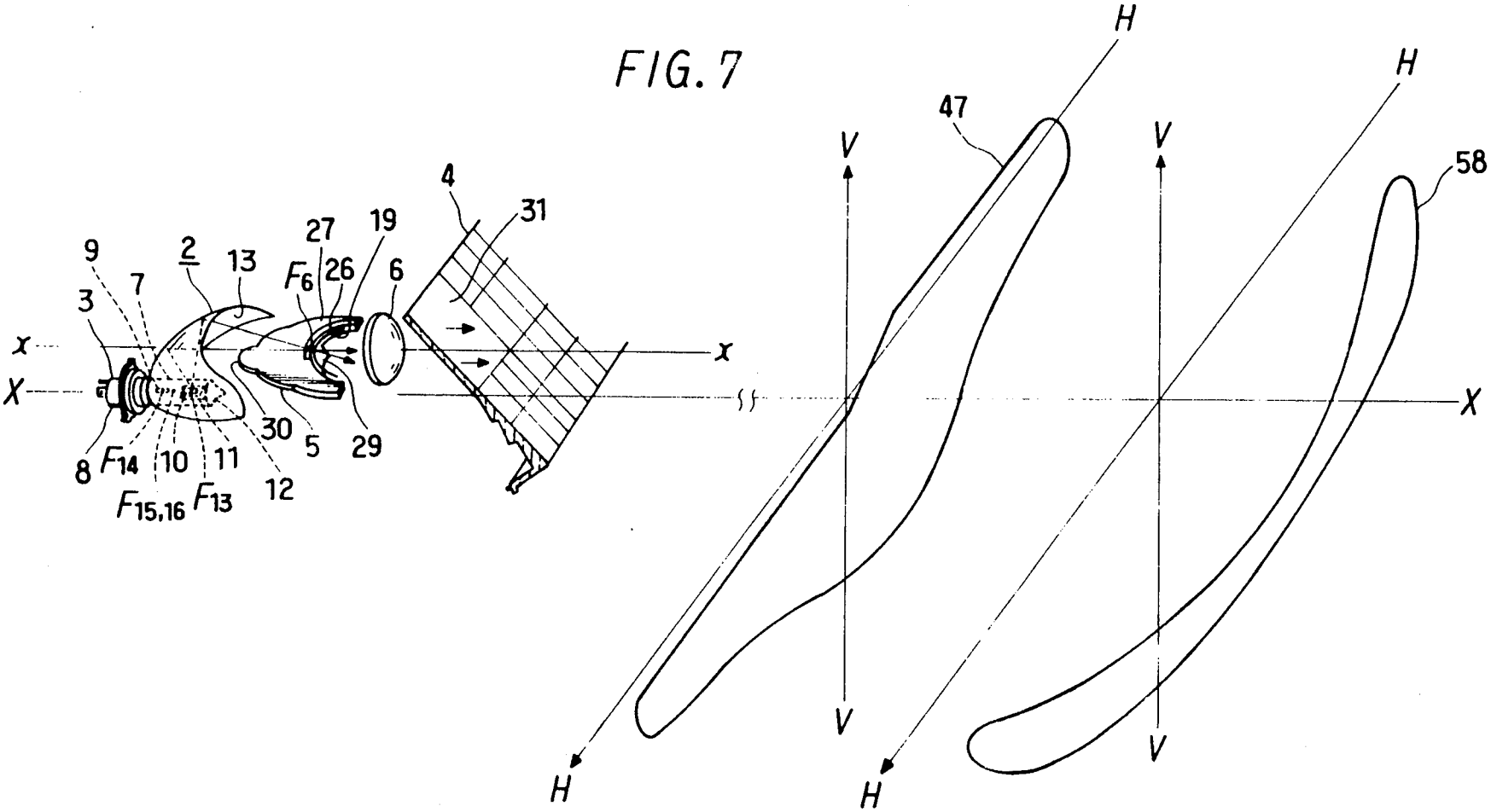
FIG. 7 is a perspective view illustrating an upper reflective surface and relating parts of the automotive projector type headlight of FIG. 1.
Figure 8:
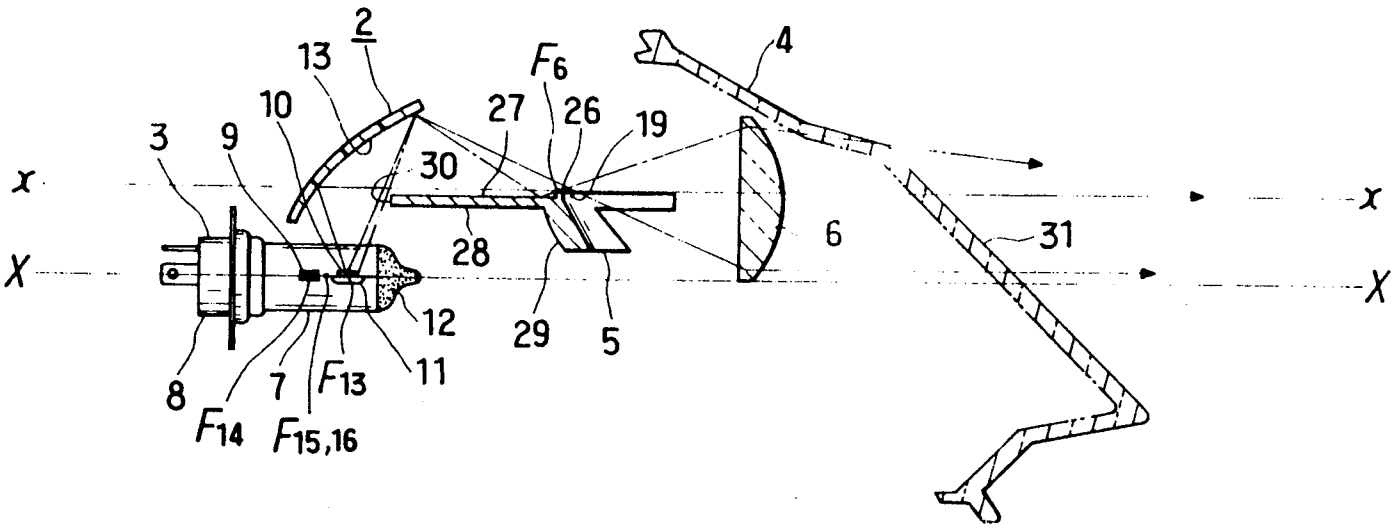
FIG. 8 is a longitudinal sectional view of FIG. 7.
Figure 9:
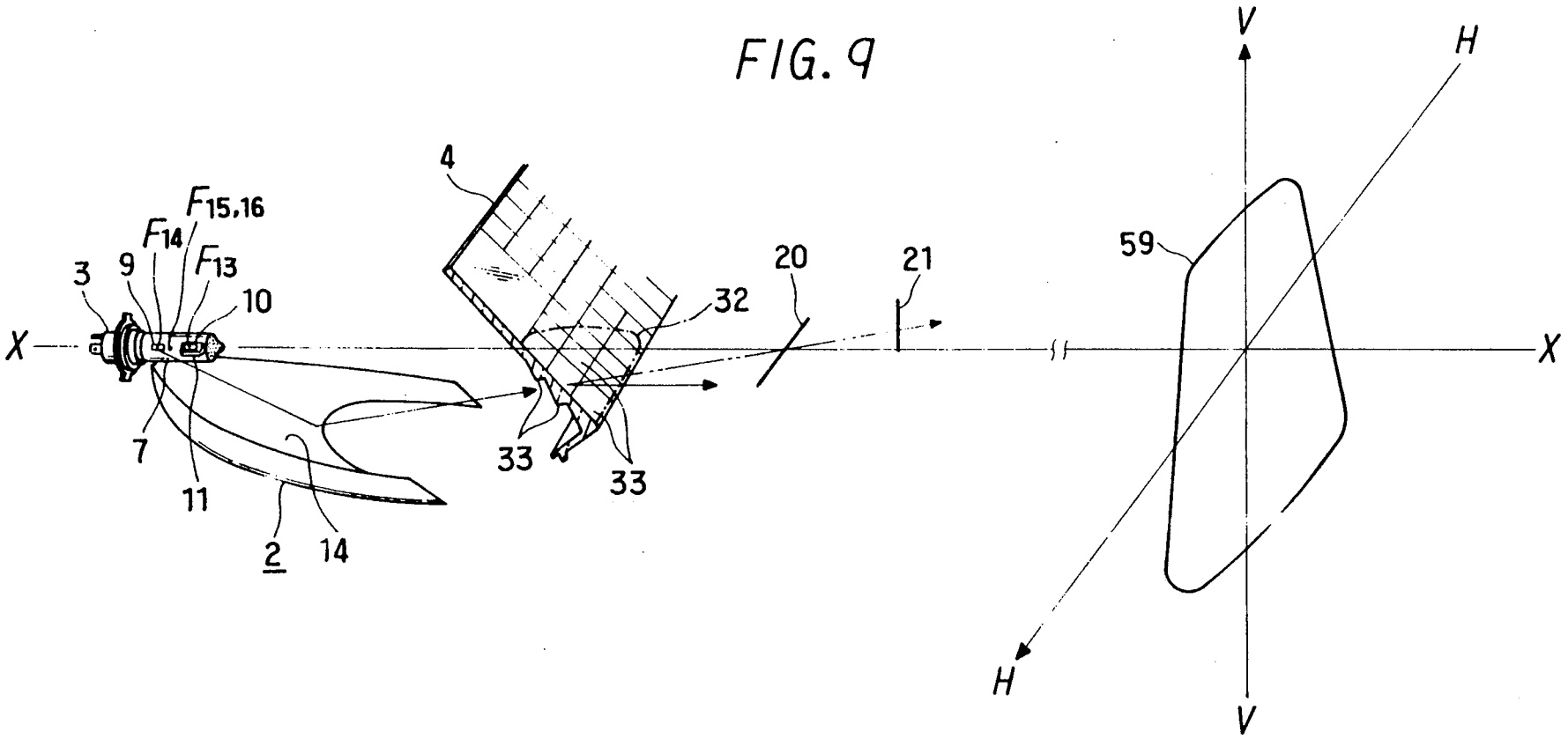
FIG. 9 is a schematic perspective view illustrating a lower reflective surface and relating parts of the headlight of FIG. 1.
Figure 10:
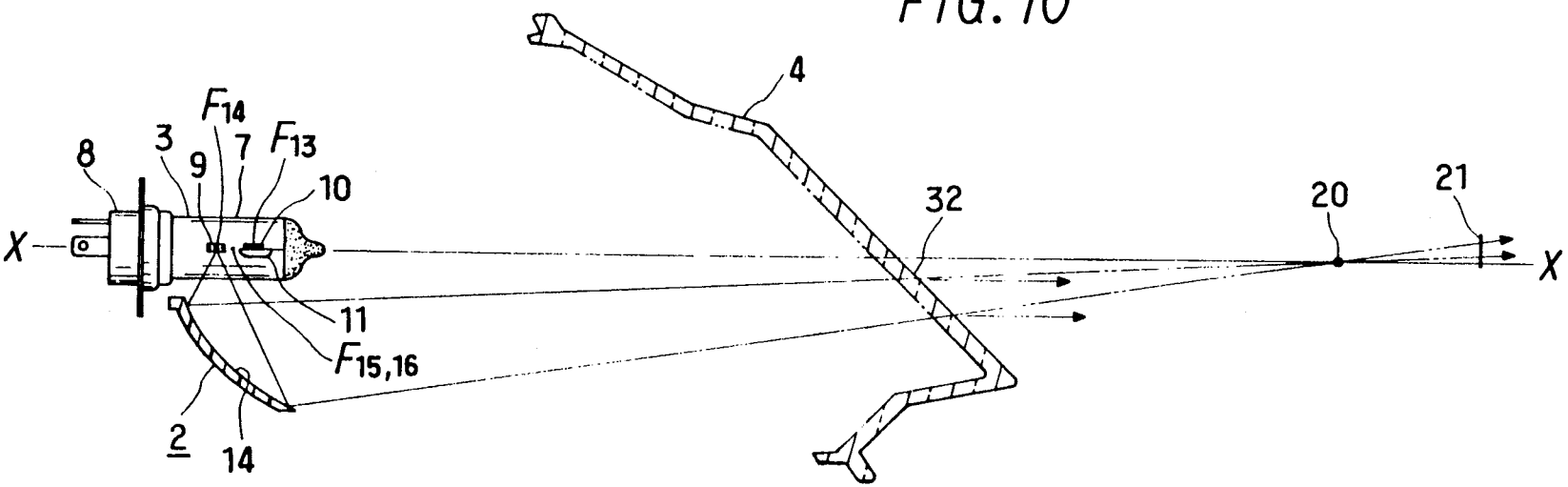
FIG. 10 is a longitudinal sectional view of FIG. 9.
Figure 11:
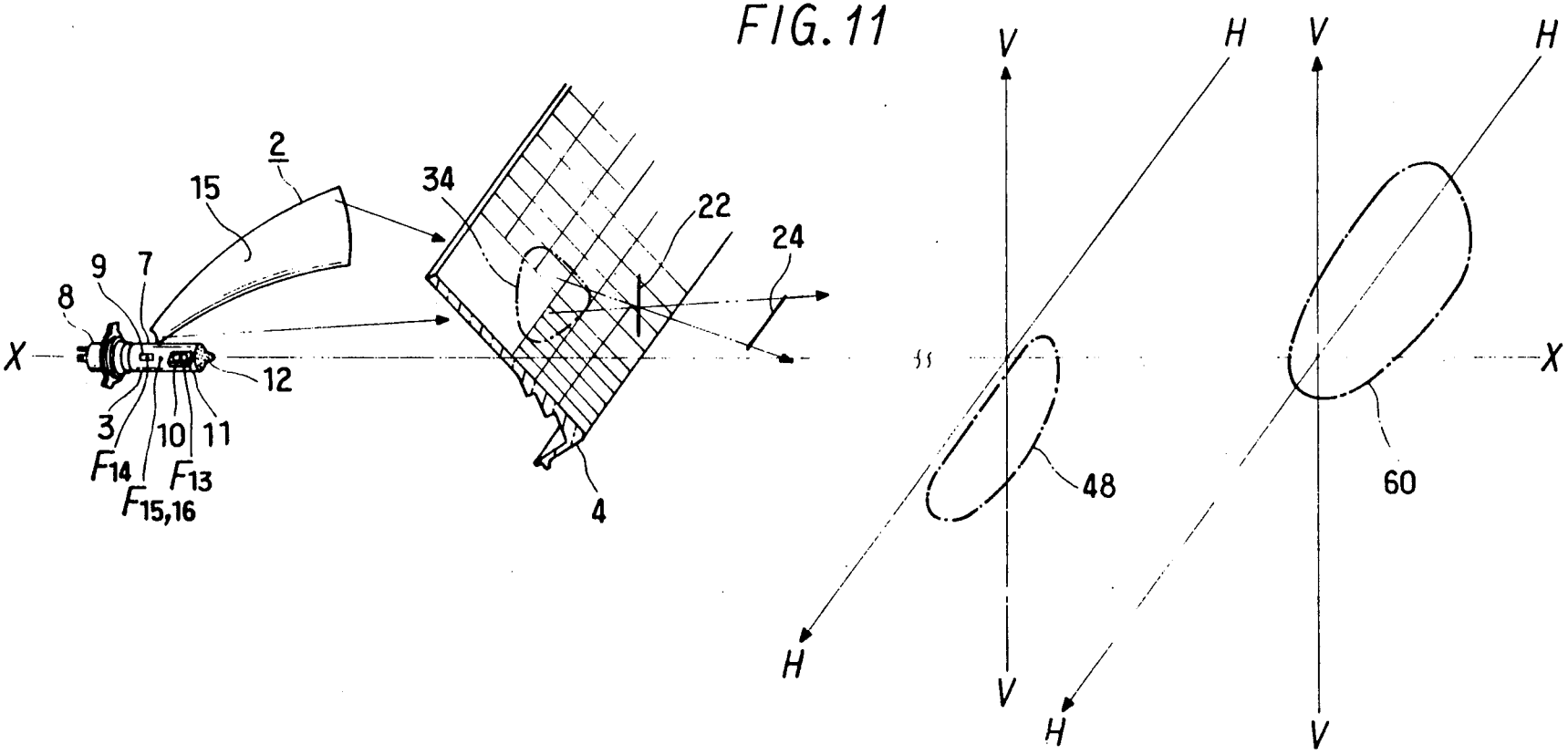
FIG. 11 is a schematic perspective view illustrating a reflective surface of the inner left side and relating parts of the headlight of FIG. 1.

The shade member 5 is disposed generally horizontally and spaced upward from the optical axis X—X, and the shading edge 26 being located near to the converging position 19 of the upper reflective surface portion 13 for shading or cutting a part of the light rays at this position. The shading edge 26 is curved, as shown in FIGS. 1, 5 and 7, to conform with the curvature of the image of the projector lens 6 so that the projected image field of the lens 6 is clear and distinct from the center to the opposite ends of the shading edge 26 and a clear cutoff line is projected.

Figure 2:
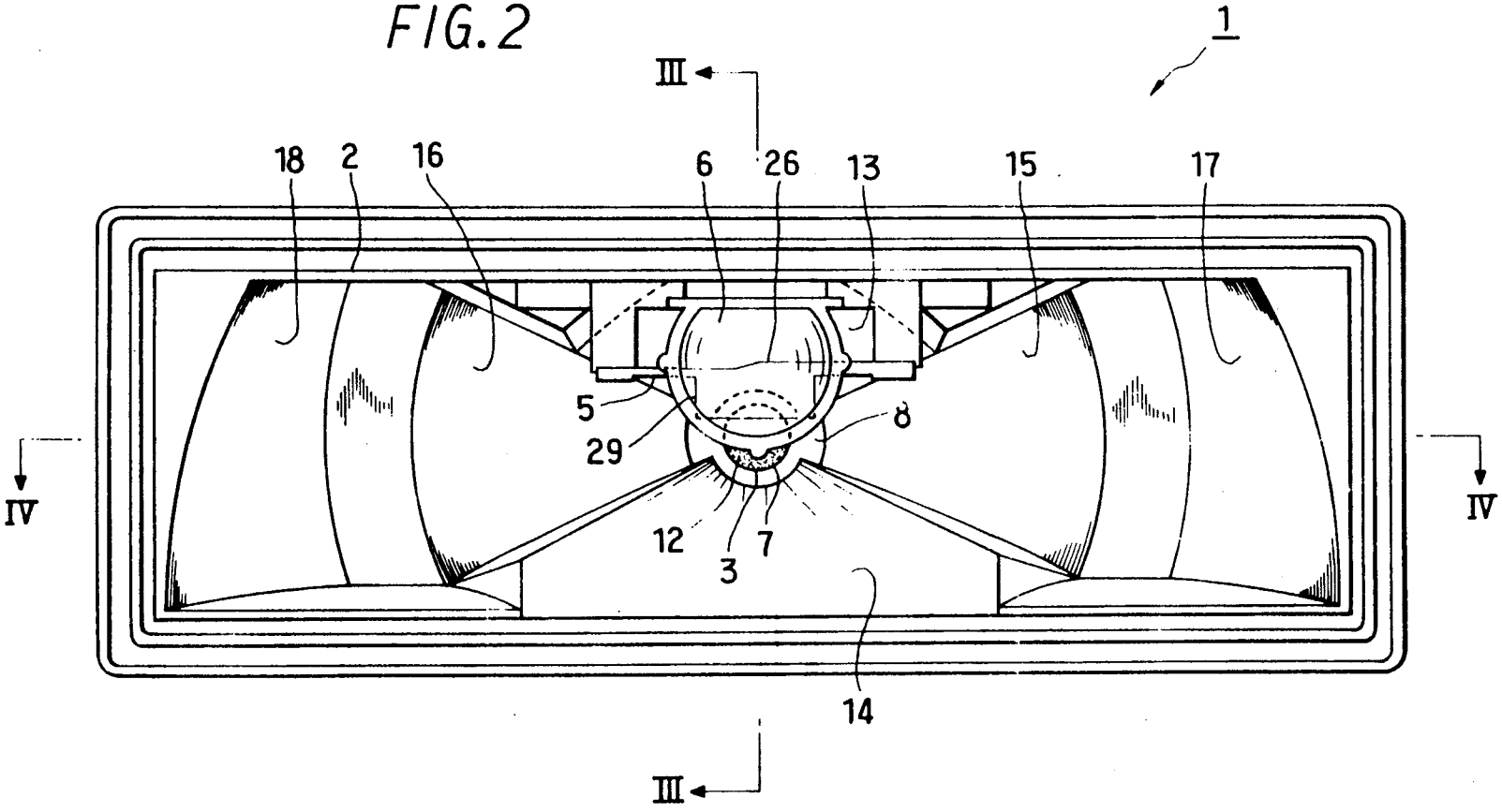
FIG. 2 is a front view of the headlight of FIG. 1 with a cover lens being removed.

Incidentally, the shape of the shading edge 26 as seen from the front is, as shown in FIG. 2, adapted to form a desired cutoff line 40 (FIG. 12A) in the projected beam pattern of the low beam. It will be noted that the drawings show the pattern for left side running vehicles such as in Japan and in United Kingdom.

The upper surface 27 of the shading member 5 is formed into a reflective surface by vapor deposition means and the like, whereby the light rays injected on the upper surface 27 are reflected thereby and are injected on the upper half portion of the projector lens 6. The lower half portion of the projector lens 6 is injected by the light rays not being cut by the shading member 5, thus, the entire surface of the lens 6 is injected by light rays, so that the bleeding of the color due to chromatic aberration of the projector lens 6 on the periphery of the light distribution pattern particularly along the cutoff line can be avoided and the light rays are utilized effectively.

The lower surface 28 of the shading member 5 is formed also into a reflective surface by vapor deposition means and the like, whereby the light rays injected on the lower surface 28 are reflected thereby and are injected forward, thus, the light rays are utilized effectively.

Shown at 29 in FIGS. 1, 3, 5, 7 and 8 is a shading portion depending from the central portion of the front edge of the shading member 5 for shading light rays being injected to the projector lens 6 from below the shading member 5.

The rear edge 30 of the shading member 5 is located slightly rear from a straight line connecting the rear end of the main filament 9 and a portion connecting the upper curved portion and a flat surface portion 2*a* of the reflective mirror 2 so that the light rays do not directly inject the flat surface portion 2*a*.

Projector Lens

The projector lens 6 is a converging lens of a convex lens with the optical axis x—x extending parallel to and above the axis X—X of the headlight 1. The focus $F_6$ is located on the center of the shading edge 26 of the shading member 5.

Cover Lens

The cover lens 4 is adapted to cover the front opening of the reflector 2 and is inclined forward and downward as shown in FIG. 3.

Figure 6:
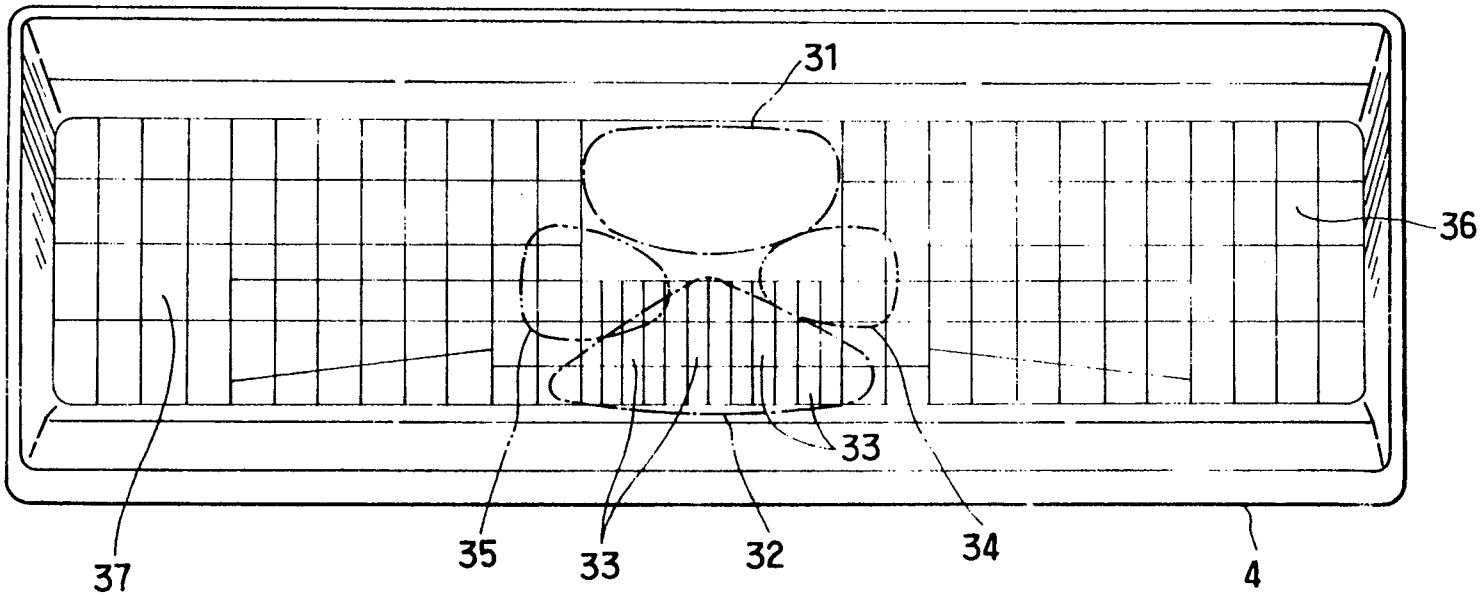
FIG. 6 is a front view.

The cover lens 4 is formed to have six sections 31, 32, 34, 35, 36 and 37 as shown in FIG. 6.

The section 31 corresponds to the projector lens 6 such that the light rays from the projector lens 6 are injected to the section 31, and the section 31 is not formed to have any lens element or a substantially flat glass portion.

The section 32 corresponds to the lower reflective surface portion 14 and is formed to have a plurality of prism steps 33, 33, . . . to coverge light rays injected from the reflective surface portion 14 into the central portion of the projected beam pattern. Further, there is provided in the section 32 some refracting property in left and right directions.

The section 34 is adapted to correspond the left inner reflective portion 15 and the section 35 to the right inner reflective surface portion 16, and are formed to have lens steps respectively such that the light rays injected from respective surface portion 15 and 16 are not distorted excessively.

The sections 36 and 37 respectively correspond to the left outer and right outer reflective surface portions 17 and 18 respectively such that the light rays from the reflective surface portions 17 and 18 form the central portion of the projected beam pattern.

Projected Beam Pattern

The projected beam patterns of the headlight 1 will now be explained.

Projected Beam Pattern A of Low Beam

Figure 12A:
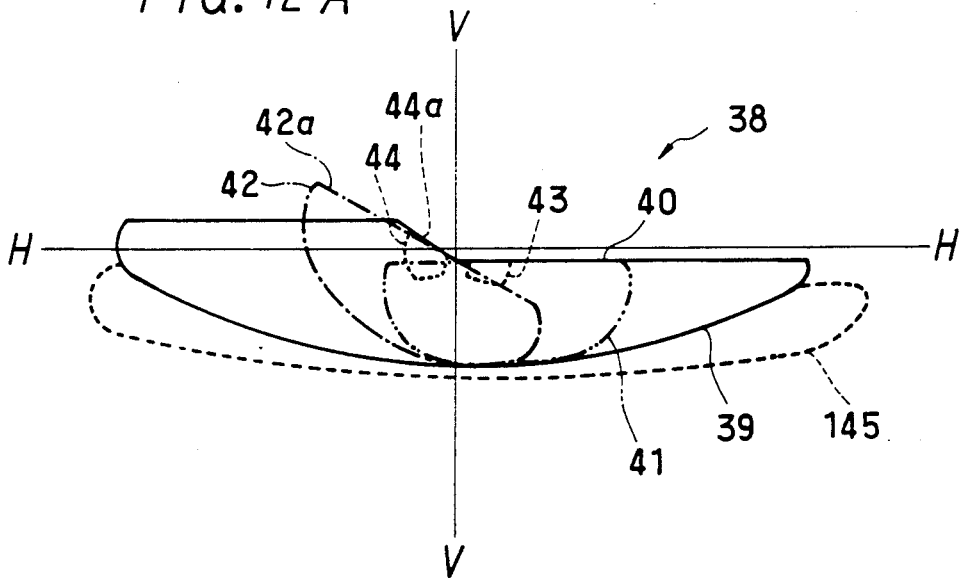
FIG. 12A shows a pattern of the lower beam of the headlight of FIG. 1 before passing through a cover lens.

FIG. 12A shows a projected beam pattern 38 of the low beam being formed by the sub-filament 10 and at the condition when the cover lens 4 is not provided.

The pattern 38 comprises a bright zone 39 being formed of light rays reflected by the upper reflective surface 13, contoured by the shading member 5 and projected by the projector lens 6. The upper edge 40 of the zone 39 is the cutoff line corresponding the shape of the shading edge 26 of the shading member 5.

A portion 41 is formed of light rays reflected on the left inner reflective surface portion 15 and a portion 42 is formed of light rays reflected on the right inner reflective surface portion 16. It will be noted that these portions 41 and 42 have the form of a young moon respectively since the light rays emitted from the sub-filament 10 and directed to the lower half portions of reflective surface portions 15 and 16 are shaded by the shading cap 11, and that the upper edge 42*a* of the portion 42 is inclined in the left upper direction since the right edge of the shading cap 11 is located slightly lower than the left edge of the shading cap 11.

A portion 43 is formed of light rays reflected on the left outer reflective surface portion 17 and a portion 44 is formed by the right outer reflective surface portion 18. Similar to the portions 41 and 42, the lower half portions of the reflective surface portions 17 and 18 do not reflect light rays, and the upper edge 44*a* of the portion 44 is inclined in the left upper direction.

Thus, the portion 39 forms the outline of the pattern, the portions 41 and 42 are located at the central portion of the pattern to form highly bright zones, and the portions 43 and 44 are also located at the central portion of the pattern to form further highly bright zones or so-called hot zones.

Accordingly, a desired projected beam pattern 38 of low beam can be obtained without the cover lens 4 which acts to somewhat modify the pattern.

The zone 145 is formed of light rays reflected on the lower surface 28 of the shade member 5 and, extends generally along the lower edge of the zone 39 and to the opposite ends as shown in the drawing.

Thus, it is possible to obtain sufficiently good beam pattern without the cover lens 4, to illuminate the neighboring portion of the lane including the shoulder portion of the lane sufficiently.

Projected Beam Pattern B of Low Beam

Figure 12B:
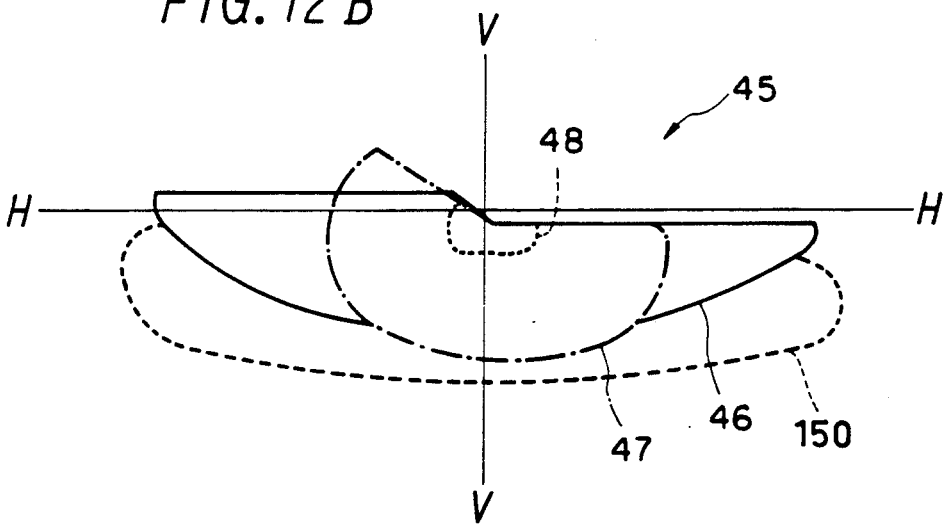
FIG. 12B shows a pattern of the lower beam of the headlight of FIG. 1 after passing through a cover lens.

FIG. 12B shows a projected beam pattern 45 of the low beam after passing through the cover lens 4.

Shown at 46 is a portion corresponding the portion 39 in FIG. 12A and passing through the section 31 of the cover lens 4. The portion 46 defines the outline of the pattern generally.

Shown at 47 is a portion corresponding the portions 41 and 42. The light rays passing through the sections 34 and 35 of the cover lens 4 are diffused somewhat in the left and right directions, thereby forming the portion 47. The portion 47 is located at the central portion of the pattern 45 and forms a highly bright zone.

Shown at 48 is a portion corresponding the portions 43 and 44. The light rays passing through the sections 36 and 37 of the cover lens 4 are expanded in the inner directions, thus forming the portion 48. The portion 48 is located at the central portion of the pattern 45 and forms the hot zone.

Thus, it is possible to obtain a sufficient amount of the light rays from a headlight having a reduced width in vertical directions, further, the inclined cover lens can be utilized without causing adverse effects.

A zone 150 is formed of light rays making the zone 145 in FIG. 12A and by passing through the cover lens 4.

Thus, it is possible to obtain a sufficient amount of light beam from a headlight having a reduced size in the vertical direction and, further, the effect of inclined cover lens can be contradicted.

Projected Beam Pattern A of High Beam

FIG. 13A shows a projected beam pattern 49 of the high beam with the main filament 9 being lit, and at the condition when the cover lens 4 is omitted.

A portion 50 is formed of light rays reflected on the upper reflective surface 13 and, extends arcuate in left and right directions at the lower portion of the pattern 49.

A portion 51 is formed of light rays reflected on the lower reflective surface 14 and, has an elongated shape in the vertical directions with the lower end positioned at the central portion of the pattern 49.

Portions 52 and 53 are formed respectively of light rays reflected on the left and right inner reflective surfaces 15 and 16 respectively. The portions 52 and 53 are elongated in the horizontal directions with the inner end portions of which being located at the central portion of the pattern 49.

A portion 54 is formed of light rays reflected on the left and right outer reflective surfaces 17 and 18 and is directed to the central portion of the pattern 49.

Projected Beam Pattern B of High Beam

FIG. 13B shows a projected beam pattern 55 of the high beam after passing through the cover lens 4.

A portion 56 corresponds the portion 50 of FIG. 13A, and is formed by the light rays being passed through the section 31 of the cover lens 4. Since the section 31 substantially has not lens function the portion 56 is similar to the portion 50 in FIG. 13A.

A portion 57 corresponds the portion 51 in FIG. 13A, and is formed by the light rays being passed through the section 32 of the cover lens 4. The central portion of the portion 57 is located nearly on the center of the pattern 55, further, the portion 57 is somewhat expanded in left and right directions.

A portion 58 corresponds the portions 52 and 53 shown in FIG. 13A. The light rays pass through the sections 34 and 35 of the cover lens 4, thus are expanded in the left and right directions. The portion 57 and 58 make an overlapping area constituting a bright zone.

A portion 59 corresponds the portion 54 in FIG. 13A, and is formed by the light rays being passed through the sections 36 and 37 of the cover lens 4. The width in the left and right directions is expanded slightly, and the portion 59 forms the hot zone in the pattern 55.

Embodiment

FIG. 14 through FIG. 27 show an automotive projector type headlight 201 according to the second embodiment of the present invention.

The headlight 201 comprises a reflective mirror 202, a lamp bulb 203, a cover lens 204 located in front of the reflective mirror 202, a shade member 205 for contouring light rays emitted from the bulb 203, and a projector lens 206 for projecting the light rays being contoured by the shade member 205.

Lamp Bulb

The lamp bulb 203 is similar to the lamp bulb 3 in the first embodiment. The corresponding parts are denoted by same reference numerals added by 200, and description therefor is omitted.

Reflective Mirror

The reflective mirror 202 is divided into an upper surface portion 213, a lower surface portion 214, left and right inner surface portions 215 and 216, and left and right outer surface portion 217 and 218.

Upper Reflective Surface Portion

The upper surface portion 213 constitutes the light projecting reflective surface according to the invention and, consists of a lower diffusing reflective portion 219 and remaining converging reflective portion 220.

The surface portion 213 has the focus $F_{13}$ nearly on the optical axis X—X of the headlight 201.

The converging reflective surface portion 220 defines a light converging position 221 upward of the axis X—X. In particular, light rays emitted from a light source on the focus $F_{13}$ and reflected on the surface 220 converge on the converging position 221.

Figure 18:
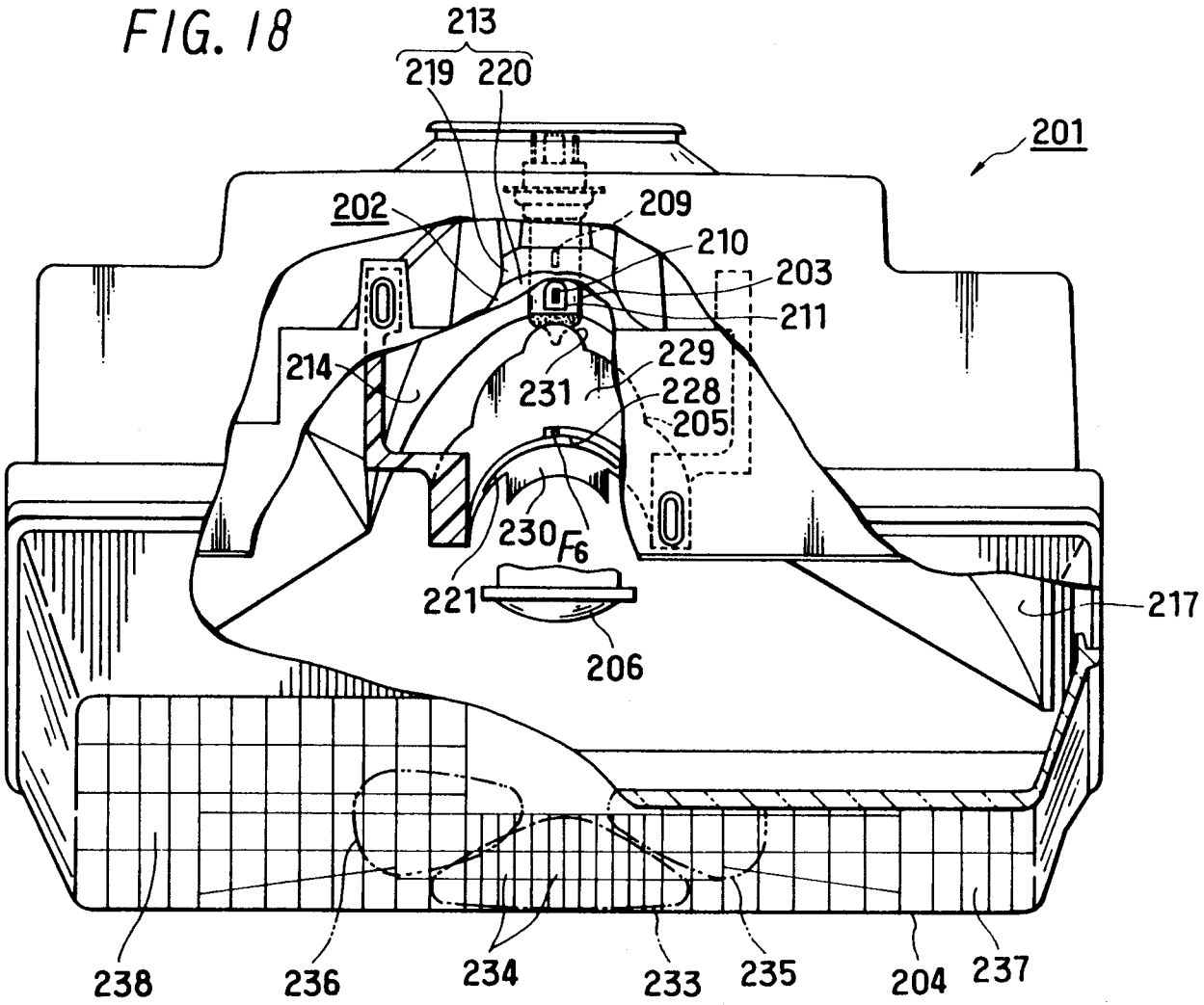
FIG. 18 is a partially broken plan view of FIG. 14.
Figure 19:
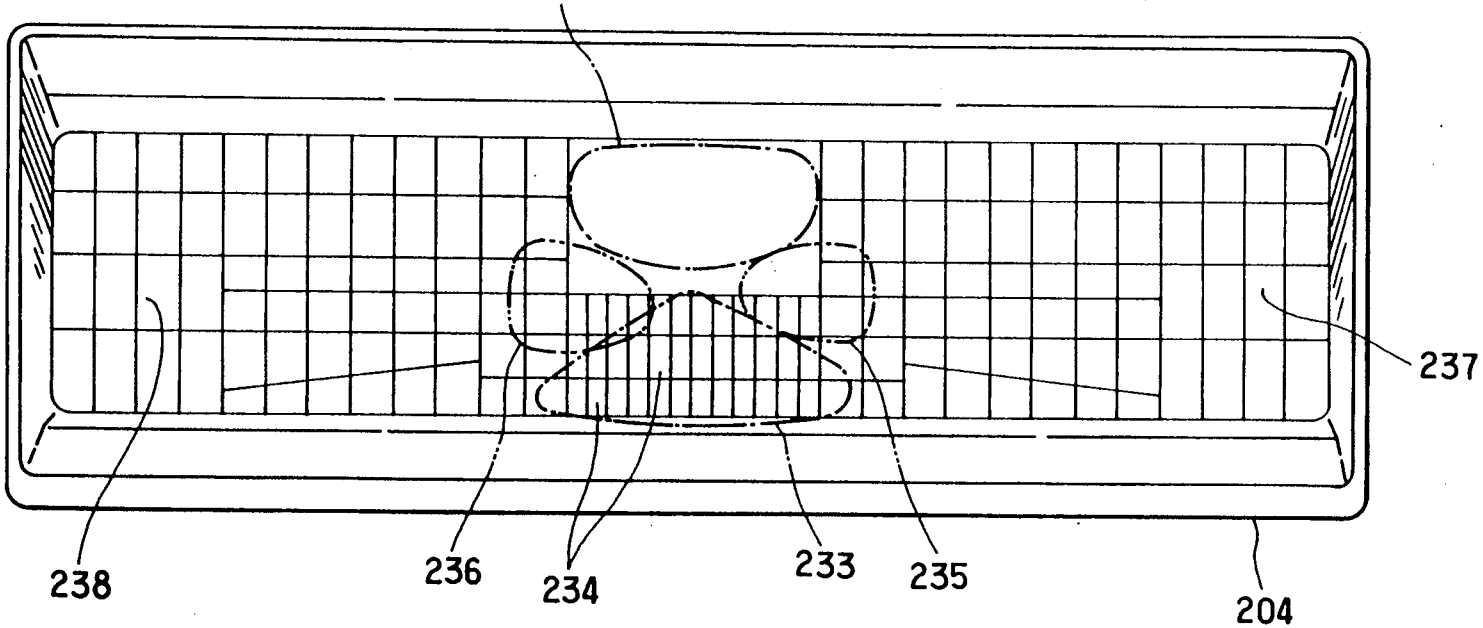
FIG. 19 is a front view of the headlight of FIG. 14.
Figure 20:
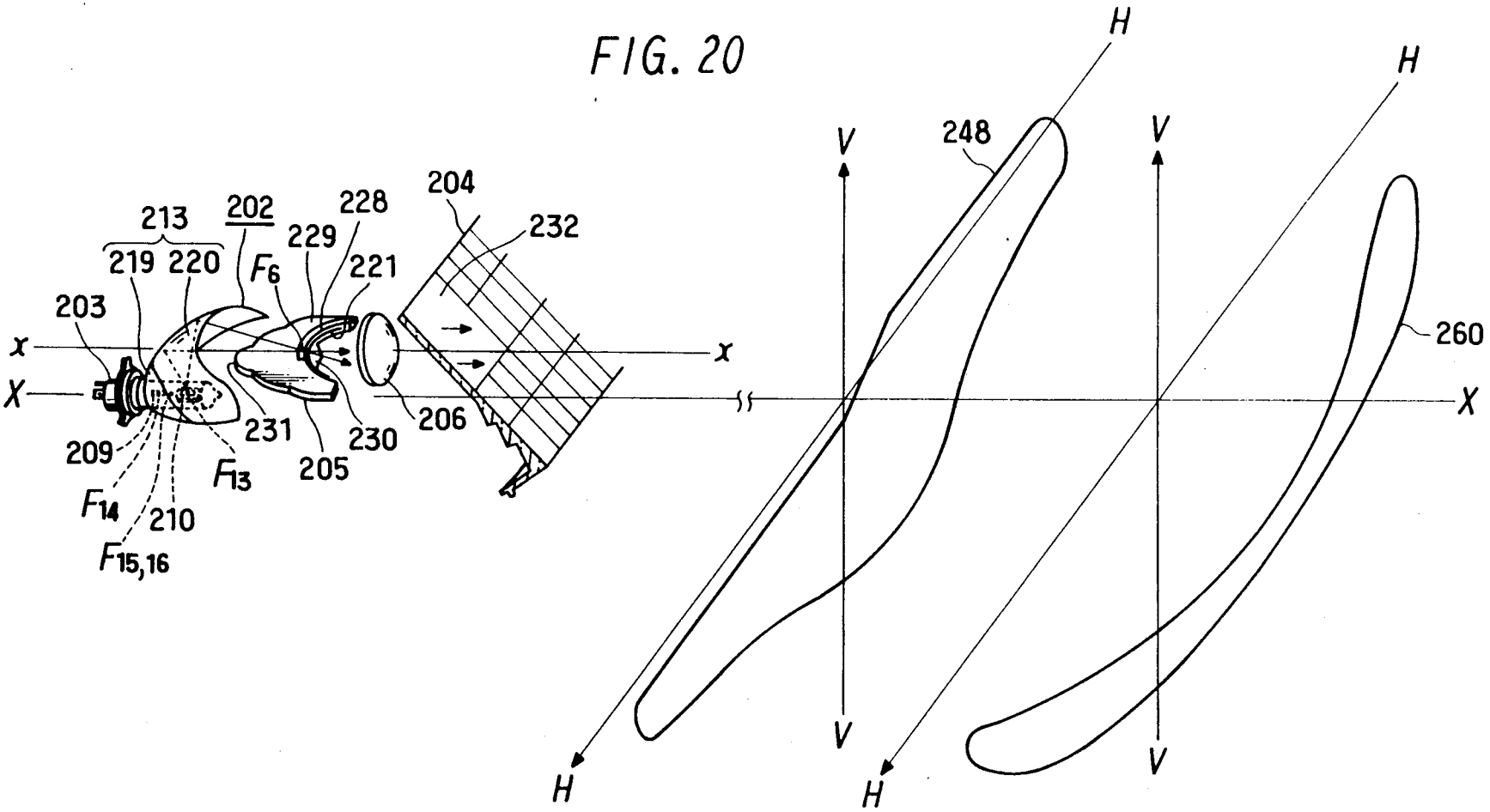
FIG. 20 is a schematic perspective view showing a reflective surface and relating parts of the headlight of FIG. 14.
Figure 21:
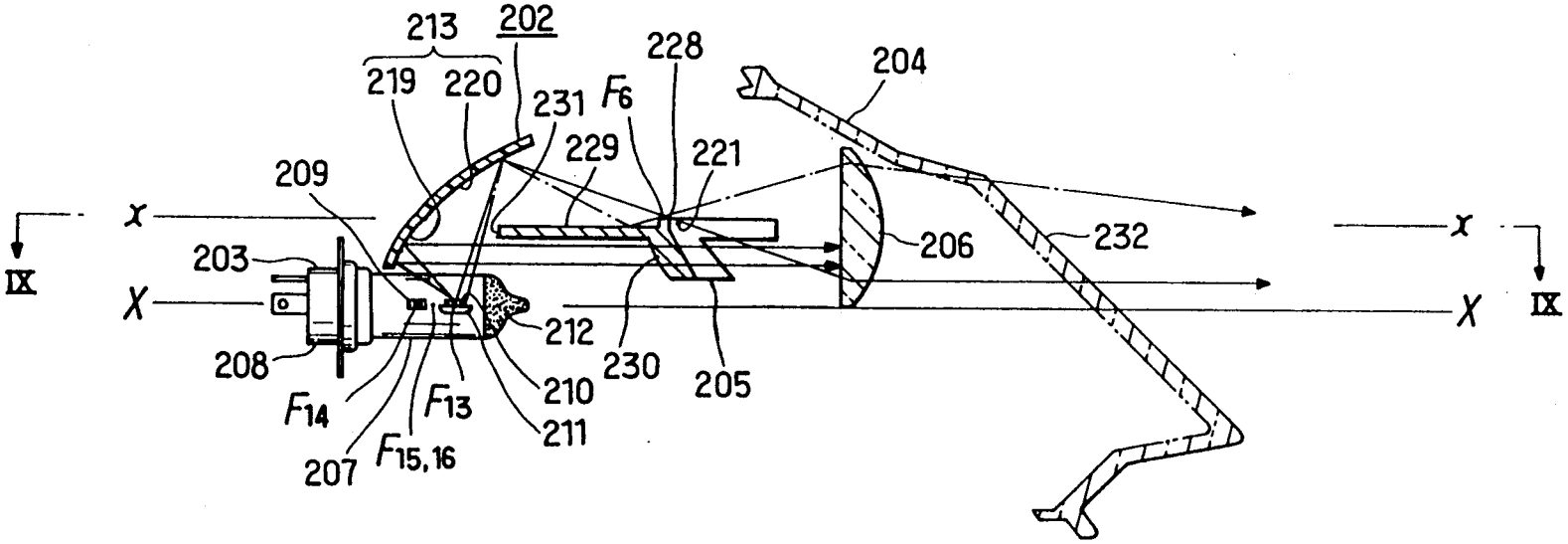
FIG. 21 is a longitudinal sectional view of FIG. 20.
Figure 22:
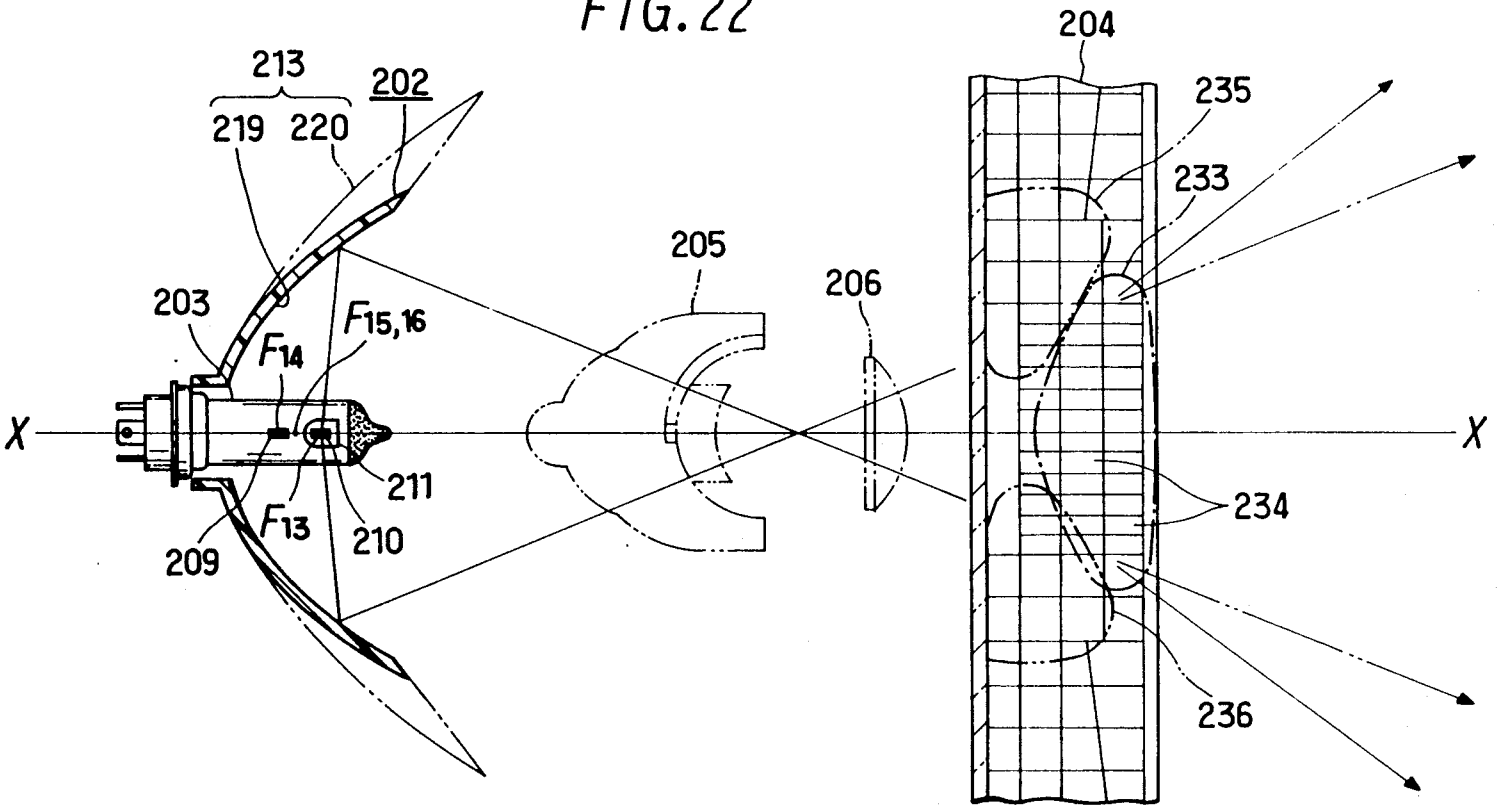
FIG. 22 is a sectional view taken generally along line IX—IX in FIG. 21.
Figure 23:
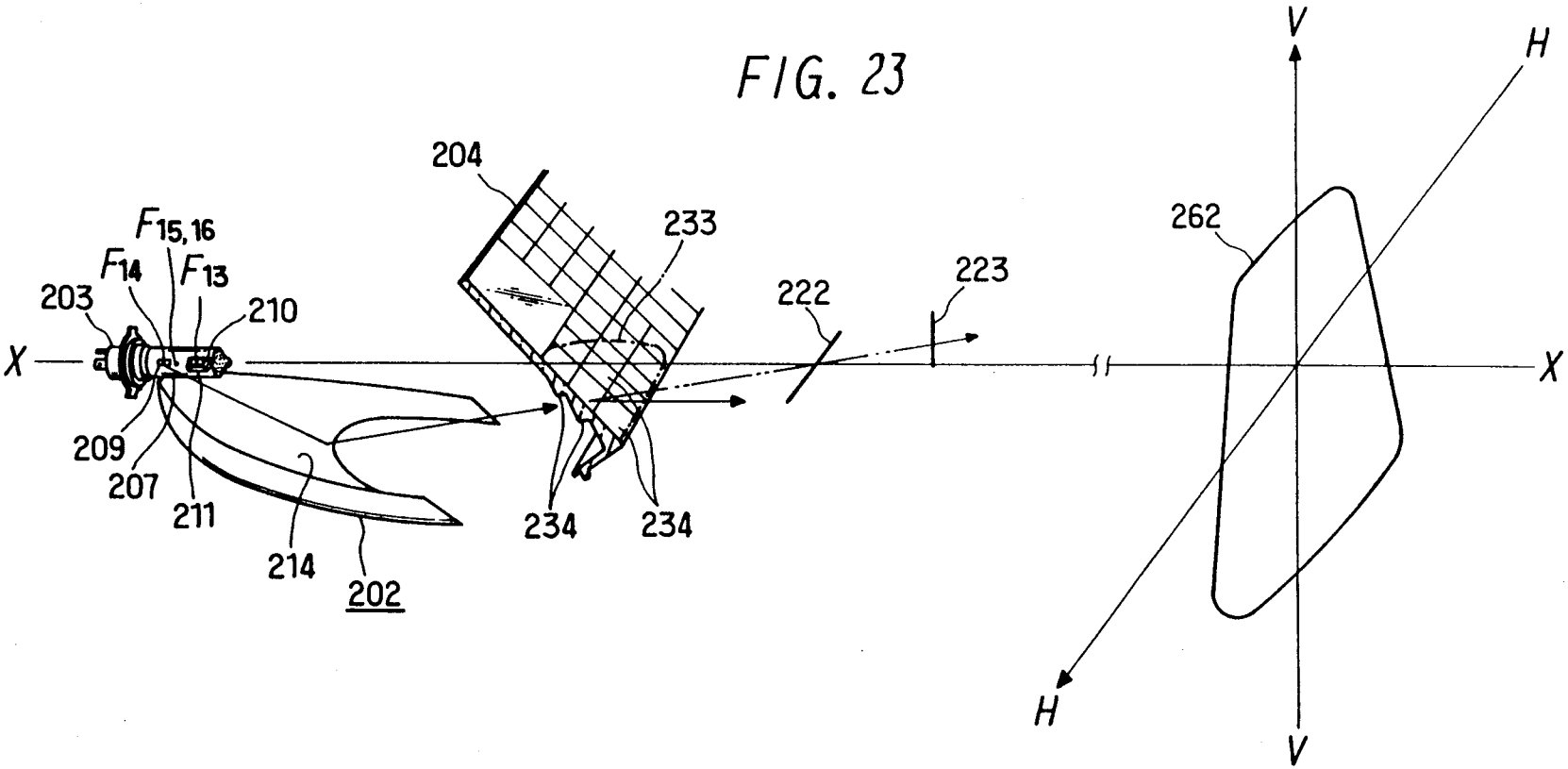
FIG. 23 is a schematic perspective view showing a lower reflective surface and relating parts of the headlight of FIG. 14.
Figure 24:
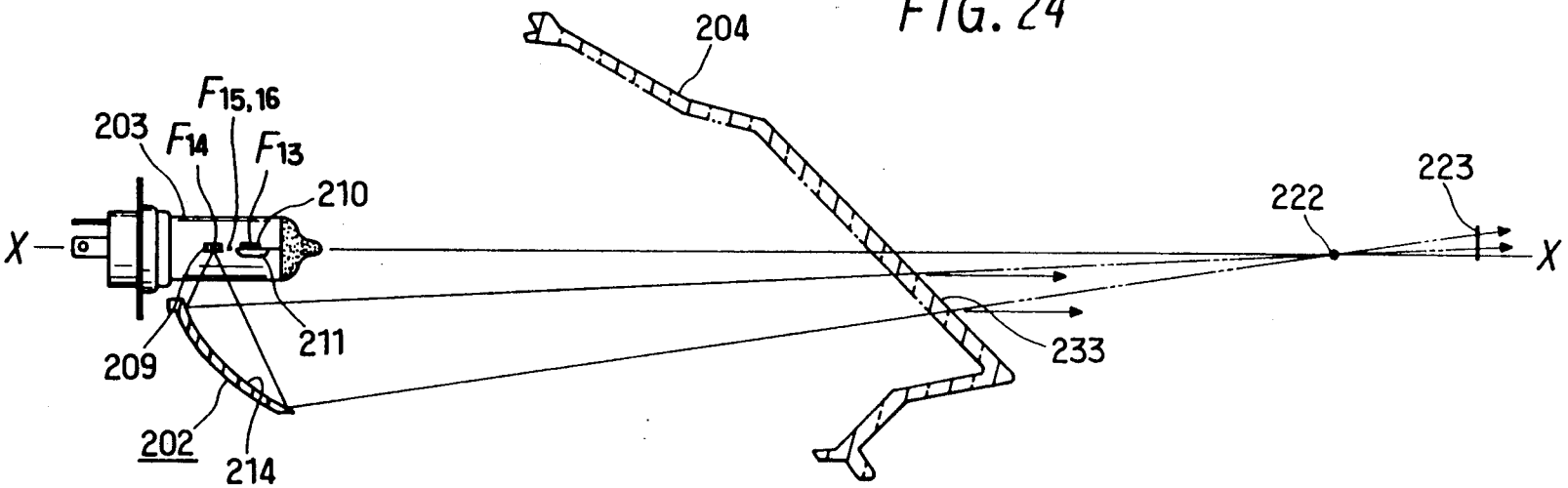
FIG. 24 is a longitudinal sectional view of FIG. 23.
Figure 25:
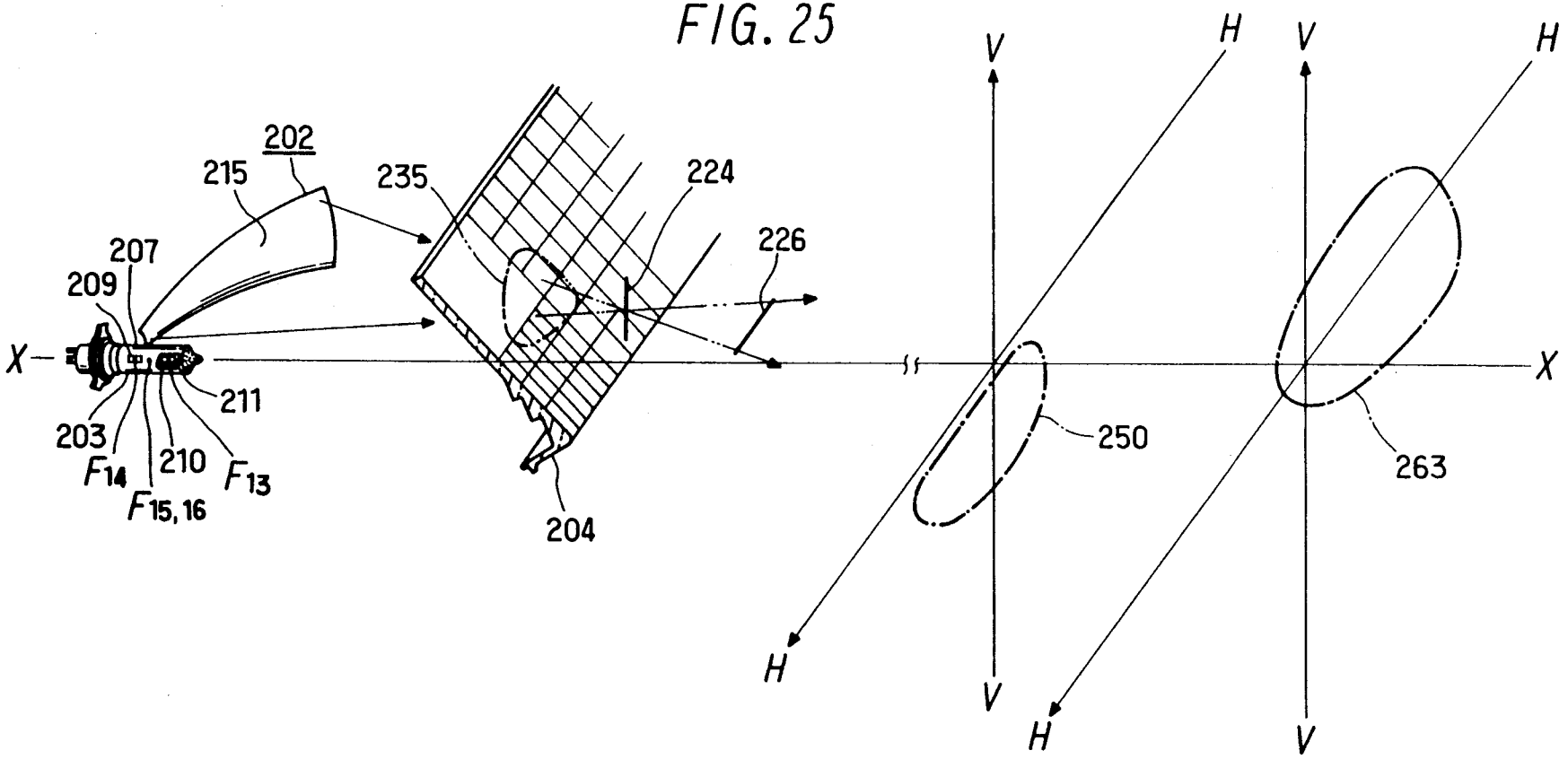
FIG. 25 is a schematic perspective view showing a left inner reflective surface and relating parts of the headlight of FIG. 14.

In the embodiment, the converging position 221 extends generally horizontally and, in the plan view, is curved such that the opposite ends are positioned forward of the central portion as shown in FIG. 18.

One example adapted for use as the reflective surface portion 220 is described in U.S. patent application Ser. No. 07/334,618.

The diffusing reflective surface portion 219 has the surface of an ellipse in the horizontal section and of a parabola in the vertical section, with the first focus of the ellipse and the focus of the parabola coincide with the focus $F_{13}$ of the surface 213. Further, the axis of the ellipse and the axis of the parabola are common and is parallel to the axis X—X or inclined slightly downward and forward.

Thus, light rays emitted from a light source on the focus $F_{13}$ are projected parallel to or inclined slightly downward and forward with respect to the axis X—X and, in the horizontal direction, converge at the second focus of the ellipse and thereafter are expanded.

Lower Reflective Surface Portion

The lower surface portion 214 defines a focus $F_{14}$ at the location rearward of the focus $F_{15}$ of the surface 213, a first light converging position 222 of a straight line crossing the axis X—X and extending horizontally, and a second light converging position 223 of a straight line crossing the axis X—X at the location in front of the line 222 and extending vertically.

Thus, light rays emitted from a light source located at the focus $F_{14}$ are reflected on the surface 214 will converge at the first converging position 222 and, converge at the second converging position 223.

Such reflective surfaces can also be obtained from the specification in U.S. patent application Ser. No. 07/334,618, now U.S. Pat. No. 4,922,389 in which parameters in the equations for determining the reflective surface should be determined suitably so as to define the first and second converging positions as straight lines 222 and 223.

Left and Right Inner Reflective Surface Portions

The left and right inner reflective surface portions 215 and 216 are surfaces for reflecting light rays emitted from a light source being located at focus $F_{15}$ and $F_{16}$ thereof to converge in left and right directions and, thereafter, diffuse them. The focus $F_{15}$ and $F_{16}$ are located between the focus $F_{13}$ of the upper reflective surface 213 and the focus $F_{14}$ of the lower reflective surface 214.

Figure 14:
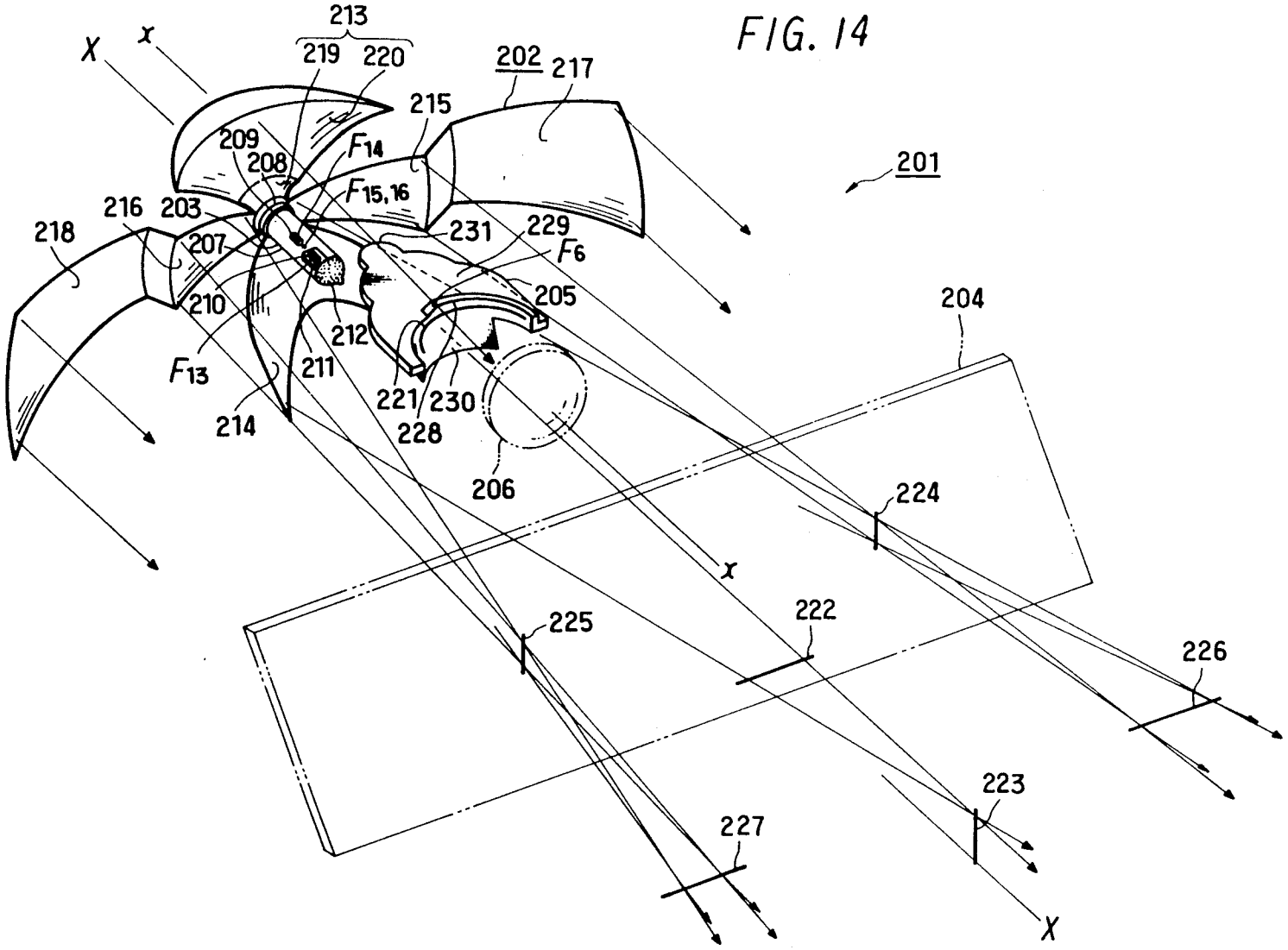
FIG. 14 is a schematic perspective view of a headlight according to a second embodiment of the invention.
Figure 15:
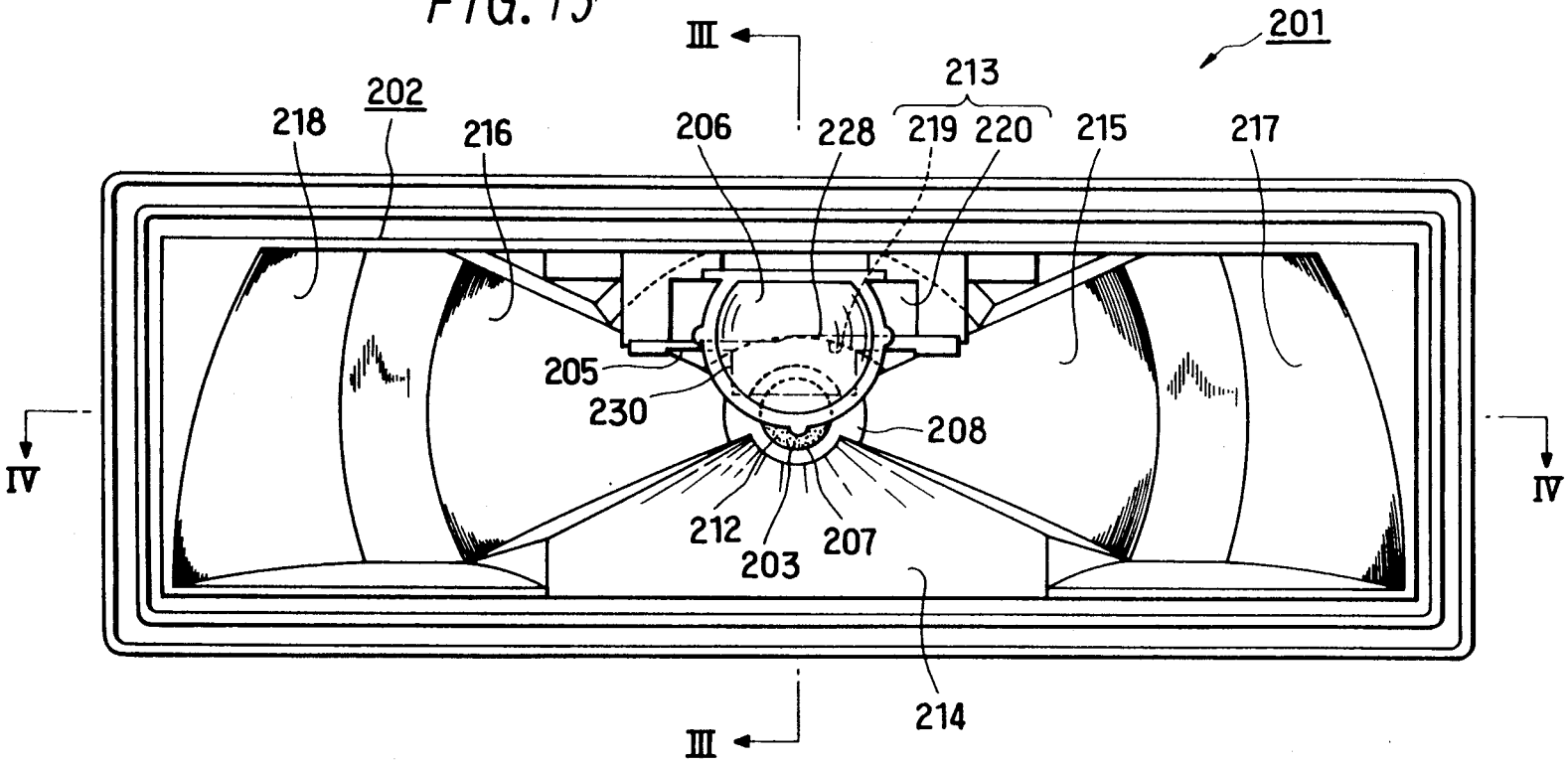
FIG. 15 is a front view of the headlight of FIG. 14 with a cover lens being removed.
Figure 16:
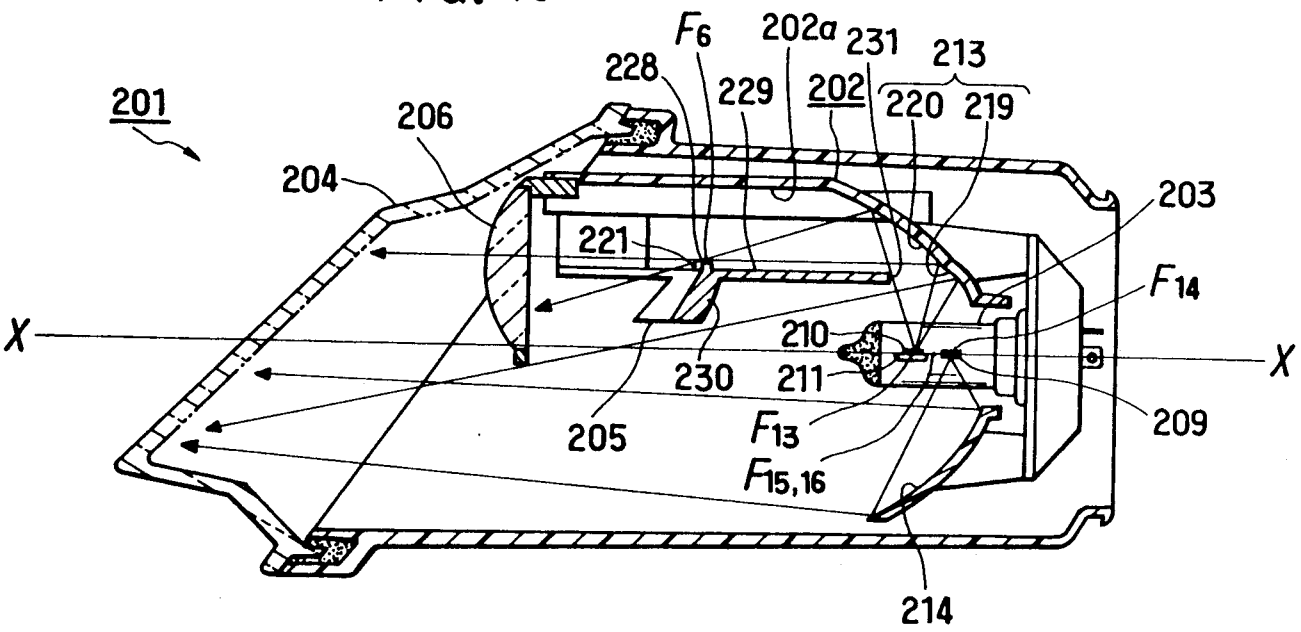
FIG. 16 shows a section view taken generally along line III—III in FIG. 15.
Figure 17:
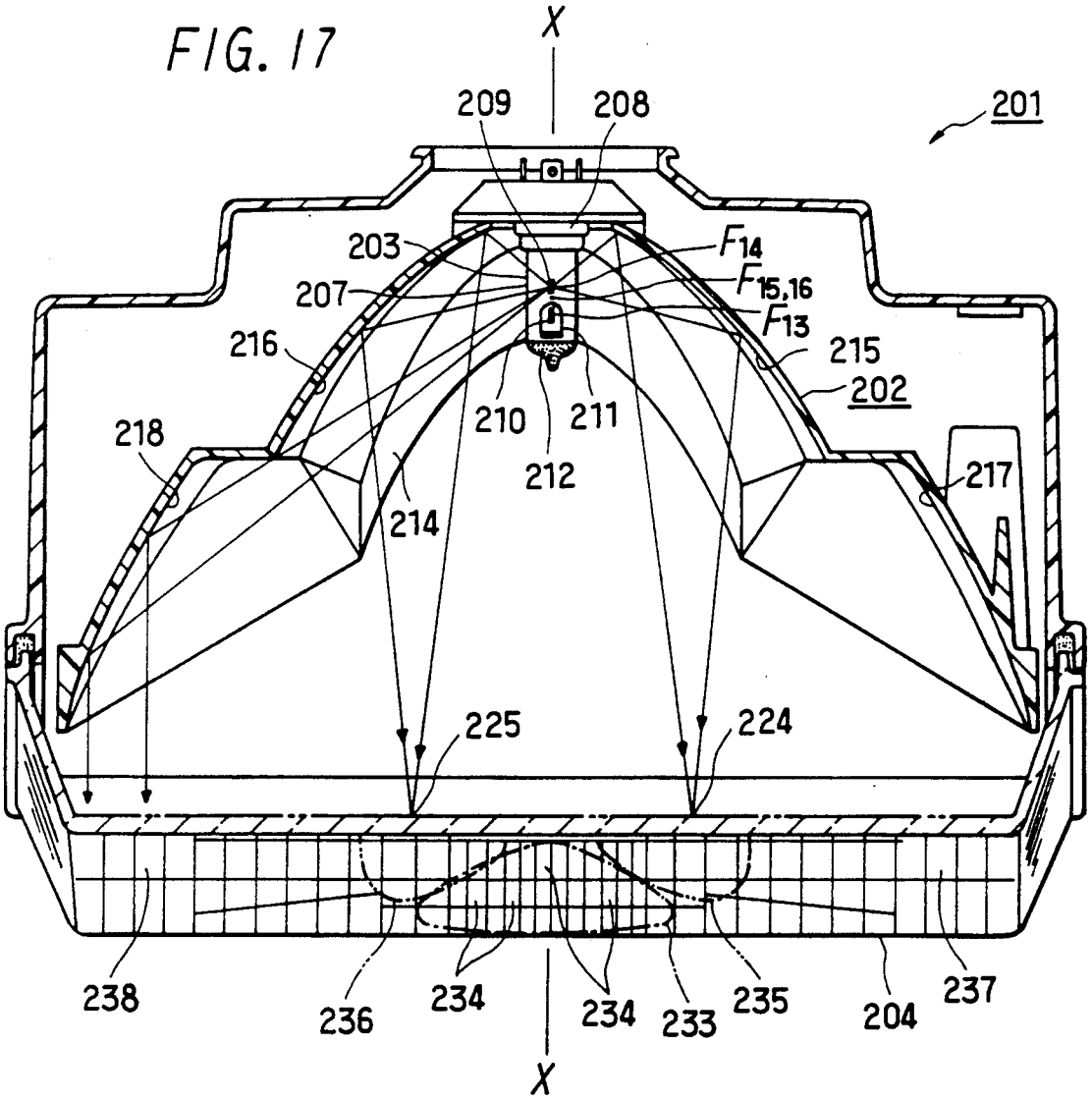
FIG. 17 shows a section view taken generally along line IV—IV in FIG. 15.

The first converging positions of the surfaces 215 and 216 are vertical straight lines 224 and 225 respectively and the second converging positions are horizontal lines 226 and 227 respectively as shown in FIG. 14.

Such reflective surfaces can also be obtained from the above mentioned U.S. patent application Ser. No. 07/334,618 now U.S. Pat. No. 4,922,389. By setting the size of the surfaces 215 and 216 and the position of the first converging positions 224 and 225, the angle of diffusion of light rays in left and right directions can be determined as desired. For example, when the first converging positions 224 and 225 are near to the reflective mirror 202 the angle of diffusion of light rays in left and right directions increases. When the second converging positions 226 and 227 are located far from the reflective mirror 202 the light rays tend to approach parallel beam in the vertical directions.

The parallel beam in the vertical directions can be obtained from such as reflective surfaces 7 and 8 of the first embodiment shown in Japanese Patent Application 199514/1988. Further, the reflective surfaces described in U.S. patent application 07/331,981 now U.S. Pat. No. 4,916,585, can be utilized as the reflective surfaces 215 and 216.

Left and Right Outer Reflective Surface Portions

The left and right outer reflective surface portions 217 and 218 are surfaces of paraboloid of rotation with the axis being nearly equal to the optical axis X—X and the focus nearly on the focus $F_{14}$ of the lower reflective surface portion 214.

Positions of Filaments

The bulb 203 has a main filament 209 on the focus $F_{14}$ of the lower reflective surface portion 214 and a sub-filament 210 with the center of which being on the focus $F_{13}$ of the upper reflective surface portion 213.

Shade Member

The shade member 205 is of a generally plate like member with the front edge 228 forming a shading edge.

The shade member 205 is disposed horizontally and above the optical axis X—X between the diffusing and reflecting portion 219 and the converging reflecting portion 219 of the upper surface portion 213. The shading edge 228 is located near to the converging position 221 of the upper reflective surface 213 and shades a part of light rays at the position 221. The edge 228 is curved to conform with the curvature of the image field of the projector lens 206 so that the image is clear and distinct from the center to opposite ends and clear contour is formed in the projected beam pattern.

Figure 26A:
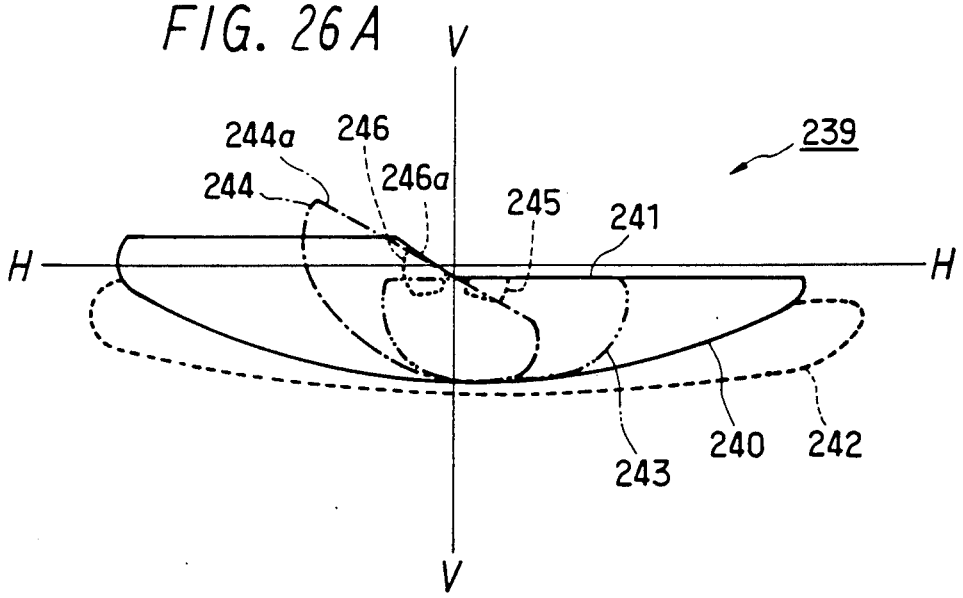
FIG. 26A shows a pattern of the lower beam of the headlight of FIG. 14 before passing through a cover lens.
Figure 26B:
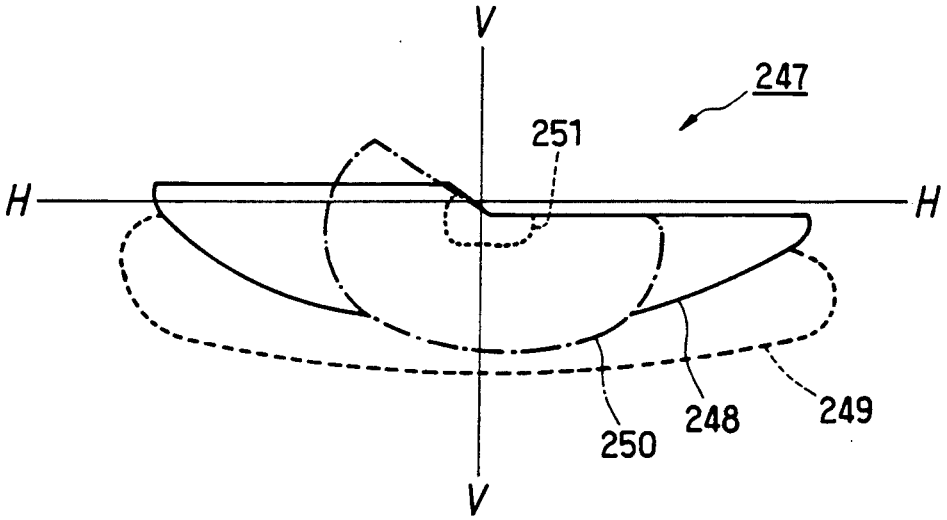
FIG. 26B shows a pattern of the lower beam of the headlight of FIG. 14 after passing through a cover lens.

The shape of the shading edge 228 as viewed in the front view corresponds desired cutoff line, as shown in FIGS. 14 and 26B, in the projected beam pattern.

The upper surface 229 of the shade member 205 is a reflective surface for reflecting light rays injected on the surface and directing them to the upper half portion of the projector lens 206. The lower half portion of the lens 206 is injected by light rays not being cut by the shade member 205, thus, the lens 206 receives the light rays along the entire surface and the bleeding of the color due to chromatic aberration of the lens 206 on the periphery of the projected beam pattern particularly along the cutoff line can be prevented and the light rays can be utilized effectively.

A shading portion 230 is formed to depend from the central portion of the shade member 205 to shade light rays being injected on the lens 206 through the lower portion of the shade member 205.

The rear edge 231 of the shade member 205 is located slightly rear from a line connecting the rear end of the main filament 209 with a boundary portion between a flat surface portion **202*a* and the outer edge of the curved surface of the reflective mirror 202** so that no light rays are directly injected on the flat surface portion.

Projector Lens

The projector lens 206 is a converging lens with the optical axis x—x extending parallel to and above the axis X—X of the headlight 201. The focus $F_6$ is on the shading edge 228 of the shade member 205.

Cover Lens

The cover lens 204 covers the front opening of the reflective mirror 202 and is inclined in downward and forward direction. And the lens 204 consists of six sections 232, 233, 235, 236, 237 and 238.

The section 232 receives light rays from the projector lens 206, and does not have any lens element.

The section 233 corresponds to the lower reflective surface portion 214 and is formed to have a plurality of prism steps 234, 234, . . . to receive light rays reflected on the surface 214 and to converge them to the central portion of the beam pattern. The section 233 has some refracting property in left and right directions.

The sections 235 and 236 correspond respectively with left and right inner reflective surfaces 215 and 216, and have respectively lens steps for not distorting largely the light rays.

The sections 237 and 238 correspond respectively with left and right outer reflective surfaces 217 and 218 and act to form the central portion of the beam pattern.

Projected Beam Pattern

Projected Beam Pattern A of Low Beam

FIG. 26A shows a projected beam pattern 239 of the low beam and when the cover lens 204 is omitted. The low beam is formed of light rays emitted from the sub-filament 210.

The pattern 239 includes a zone 240 being formed of light rays reflected on the portion 220 of the upper reflective surface portion 213 and the shape of the shading edge 228 being projected by the lens 206. The zone 240 defines general outline of the pattern 239, and the upper edge 241 of the zone 240 is the cutoff line formed by the shading edge 228 of the shade member 205.

A zone 242 is formed of light rays reflected on the portion 219 of the upper reflective surface 213, and the axis of the portion 219 is inclined slightly downward and forward. The zone 242 extends along the lower edge of the zone 240 and in left and right directions.

Zones 243 and 244 are formed of light rays reflected respectively on left and right inner surface portions 215 and 216 respectively.

Zones 245 and 246 are formed respectively of light rays reflected on left and right outer reflective surface portions 217 and 218 respectively. It will be noted that the upper edge **246*a* of the zone 246 is in the left upper direction inclined since the right shoulder of the shading cap 211** is positioned slightly below the left shoulder thereof.

The zone 240 defines the outline of the pattern, zones 243 and 244 make a highly bright zone, and the zones 245 and 246 are located on the central portion of the pattern to form so-called hot zone.

The zone 242 acts to sufficiently illuminate the nearest portion on the lane, including a shoulder portion of the lane.

Thus, the projected beam pattern 239 without the cover lens 204 is sufficiently good.

Projected Beam Pattern B of Low Beam

FIG. 26B shows a projected beam pattern 247 of the low beam being passed through the cover lens 204. The pattern 247 includes zones 248, 249, 250 and 251.

The zone 248 is formed of light rays making the zone 240 in FIG. 26A and passing through the section 232 of the lens 204 and forms the outline of the pattern 247.

The zone 249 is formed of light rays making the zone 242 in FIG. 26A and passing through the section 233 of the lens 204. The zone 249 extends along the lower edge of the pattern 248 in left and right directions and the shoulder portion of the lane can be illuminated.

The zone 250 is formed of light rays making the zones 243 and 244 in FIG. 26A and passing through the section 235 and 236 of the projector lens 204. The light rays are diffused slightly in left and right directions and the zone 250 cooperate with the zone 249 to form highly brighted zone in the pattern 247.

The zone 251 is formed of light rays making the zones 245 and 246 in FIG. 26A and passing through the section 237 and 238 of the projector lens 204. The zones 251, 250 and 248 cooperate to form the hot zone.

Thus, it is possible to obtain a sufficient amount of light beam from a headlight having a reduced vertical width, and the effect of the inclined cover lens is not observed. Further, according to the low beam the nearest portion of the lane including the shoulder portion can be illuminated sufficiently.

Projected Beam Pattern A of High Beam

Figure 27A:
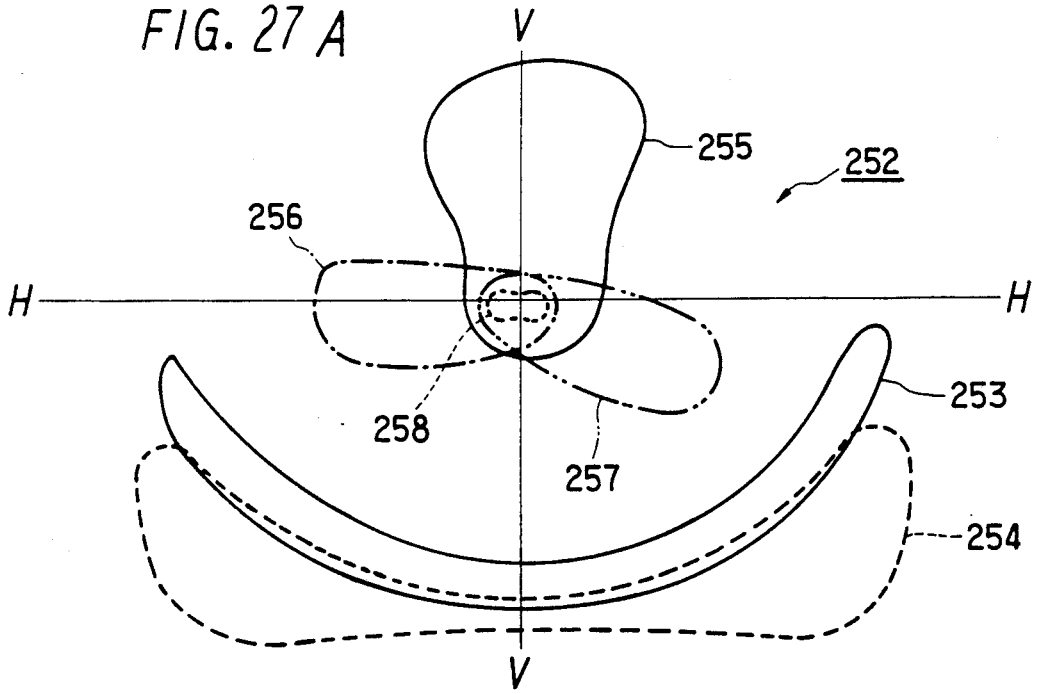
FIG. 27A shows a pattern of the high beam of the headlight of FIG. 14 before passing through a cover lens.

FIG. 27A shows a projected beam pattern 252 of the high beam and when the cover lens 204 is omitted. The high beam is formed by light rays emitted from the main filament 209. The pattern 252 includes zones 253, 254, 255, 256, 257 and 258.

The zone 253 is formed of light rays reflected on the converging reflecting portion 220 of the upper surface portion 213 and extends in left and right directions at the lower portion of the pattern 252.

The zone 254 is formed of light rays reflected on the diffusing reflecting portion 219 of the lower surface portion 214.

The zone 255 is formed of light rays reflected on the lower reflective surface 214, and has a vertically elongated form with the lower end being located at the central portion of the pattern 252.

Zones 256 and 257 are formed of light rays reflected respectively on left and right inner surface portions 215 and 216 respectively, and are elongated in left and right directions respectively with the inner ends being located at the central portion of the pattern 252.

The zone 258 is formed of light rays reflected on left and right outer reflective surface portions 217 and 218, and is located at the central portion of the pattern 252.

Projected Beam Pattern B of High Beam

Figure 27B:
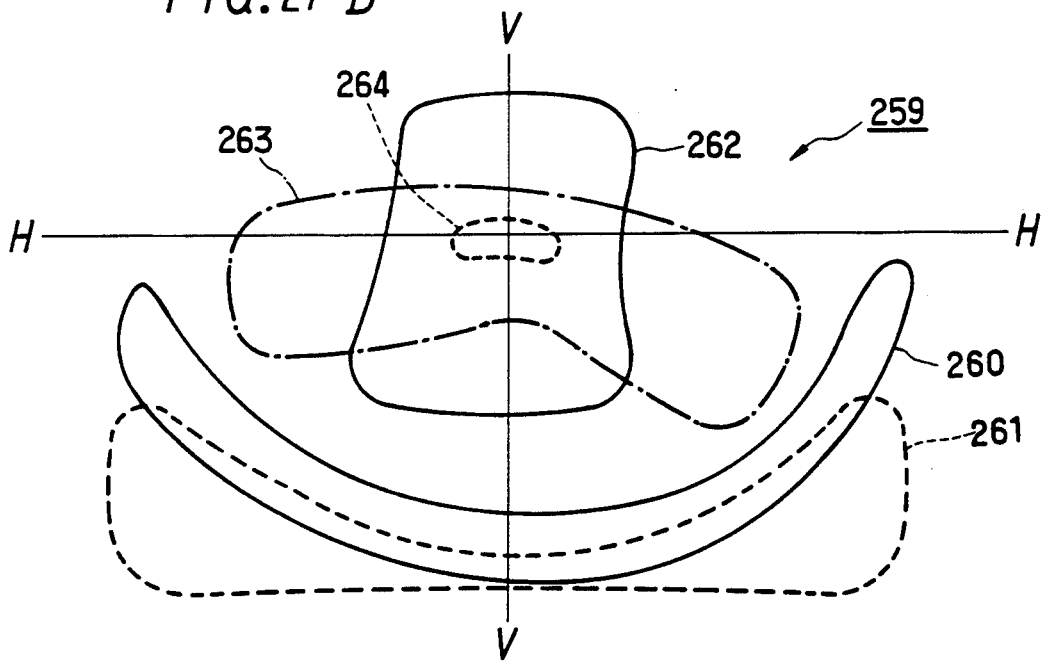
FIG. 27B shows a pattern of the high beam of the headlight of FIG. 14 after passing through a cover lens.

FIG. 27B shows a projected beam pattern 259 of the high beam being passed through the cover lens 204. The pattern 259 includes zones 260, 261, 262, 263 and 264.

The zone 260 is formed of light rays making the zone 253 in FIG. 27A and passing through the section 232 in the cover lens 204. The zone 260 is substantially similar to the zone 253 in FIG. 27A.

The zone 261 is formed of light rays making the zone 254 in FIG. 41A and passing through the section 233 in the cover lens 204.

The zone 262 is formed of light rays making the zone 255 in FIG. 27A and passing through the section 232 in the cover lens 204. The central portion of the zone 255 is displaced to the central portion of the pattern 259 and the zone 262 is expanded slightly in left and right directions.

The zone 263 is formed of light rays making the zones 256 and 257 in FIG. 27A and passing through the section 235 and 236 in the cover lens 204. The zone 263 is expanded in left and right directions.

The zone 264 is formed of light rays making the zone 258 in FIG. 27A and passing through the sections 237 and 238 in the cover lens 204.

The zones 262 and 263 cooperate to form highly bright zone, and the zones 262, 263 and 264 cooperate to form the hot zone.

Modified Embodiment

Figure 28:
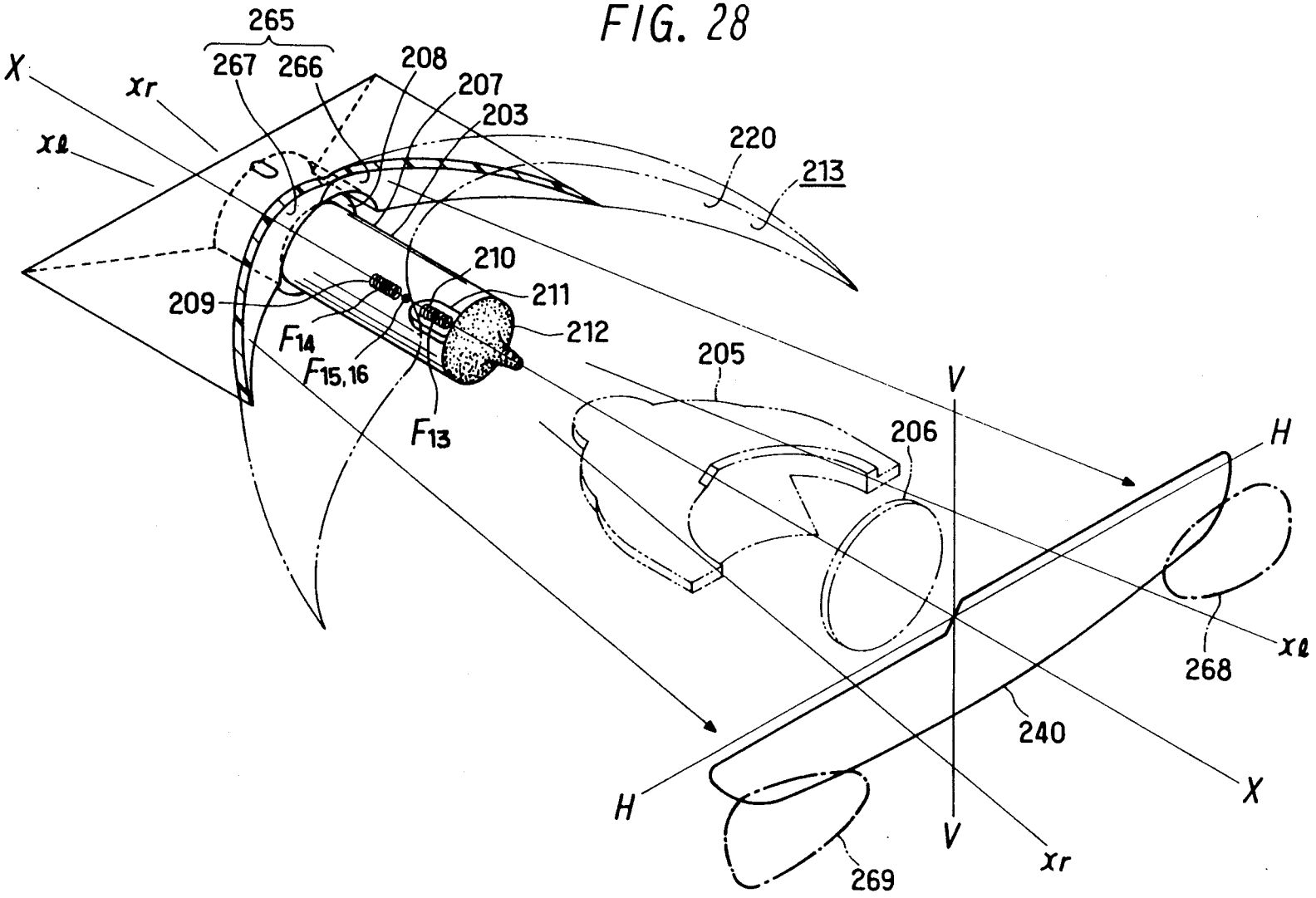
FIG. 28 is a schematic perspective view showing a diffusing and reflecting portion according to a modified third embodiment.
Figure 29:
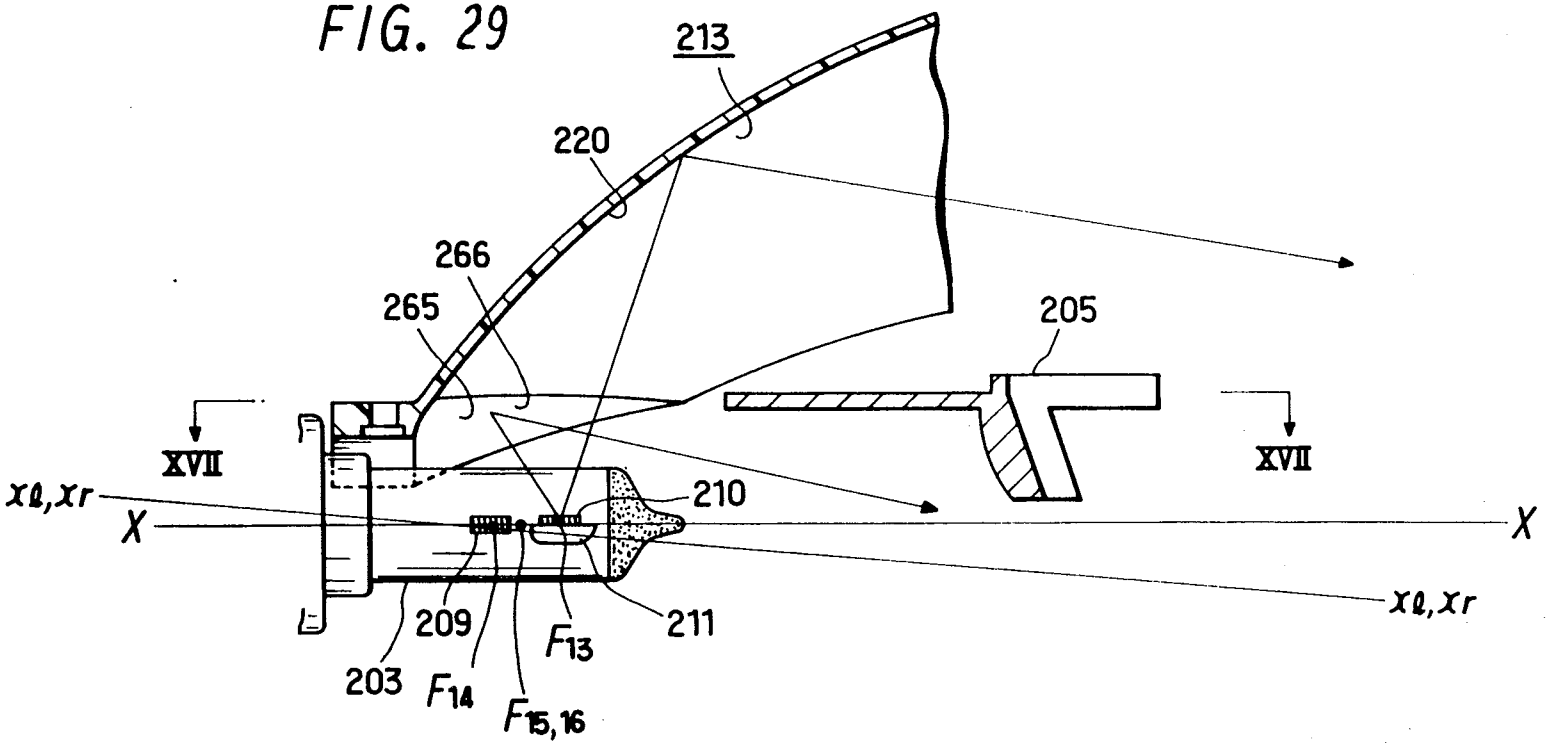
FIG. 29 is a longitudinal sectional view of FIG. 28.
Figure 30:
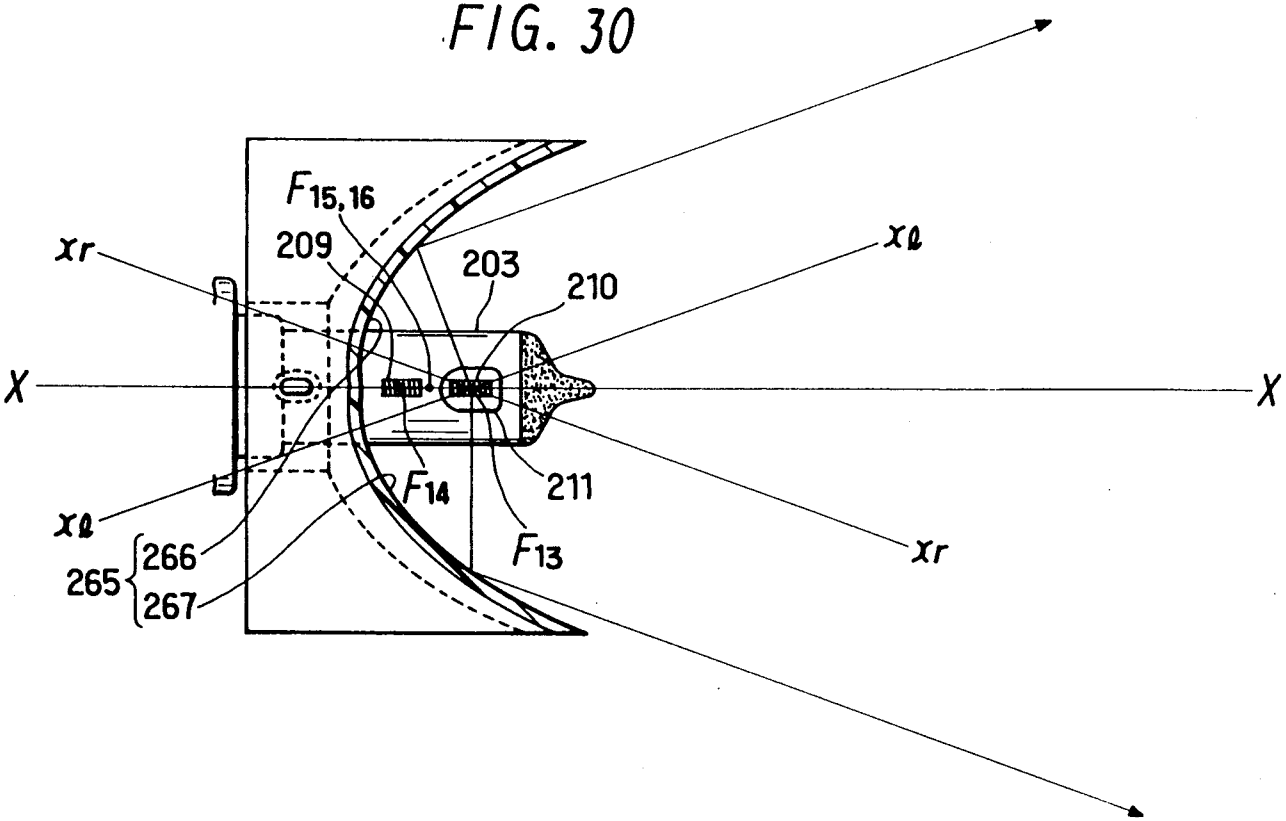
FIG. 30 is a sectional view taken generally along line XVII—XVII in FIG. 29.
Figure 31:
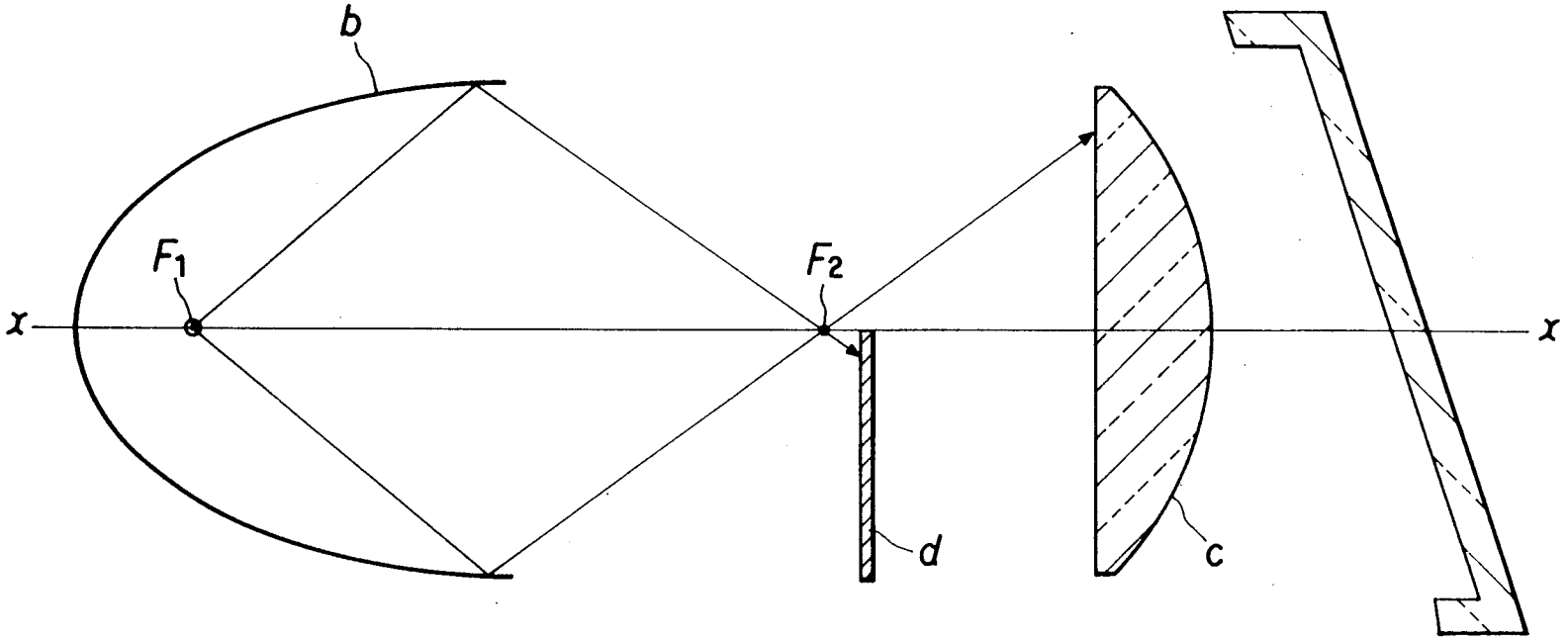
FIG. 31 PRIOR ART
FIG. 31 is a schematic view showing prior art projector type headlight.
Figure 32:
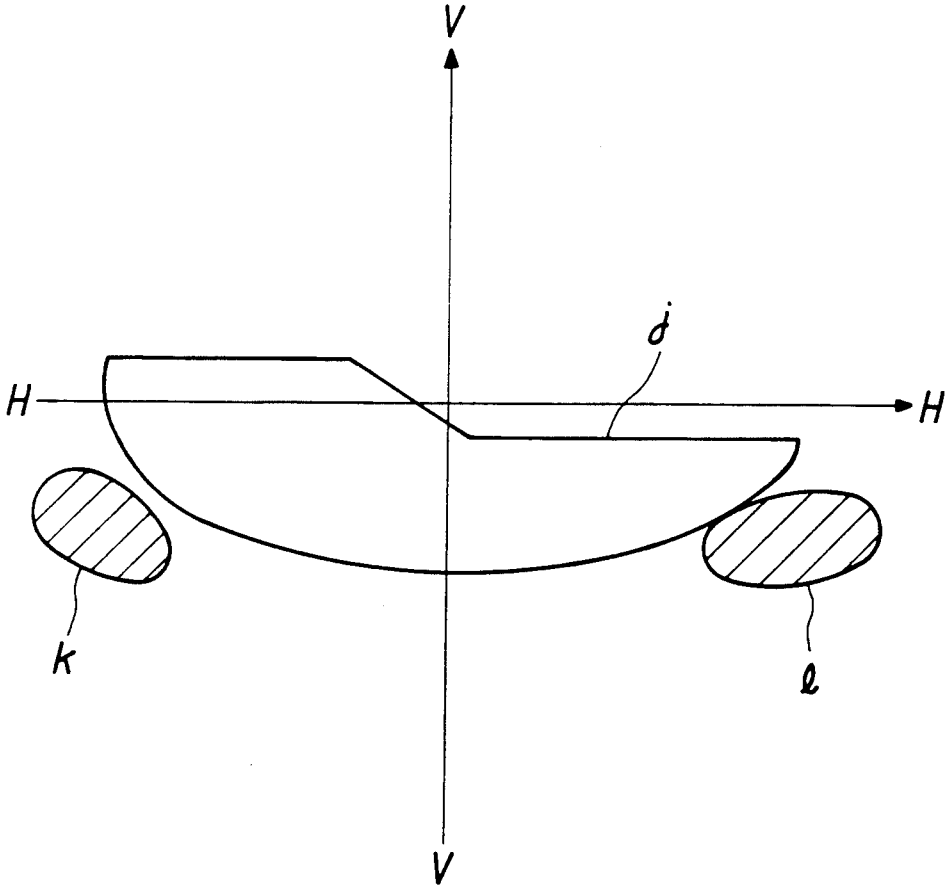
FIG. 32 PRIOR ART
FIG. 32 shows an example of light distribution pattern according to prior art projector type headlight.
Figure 33:
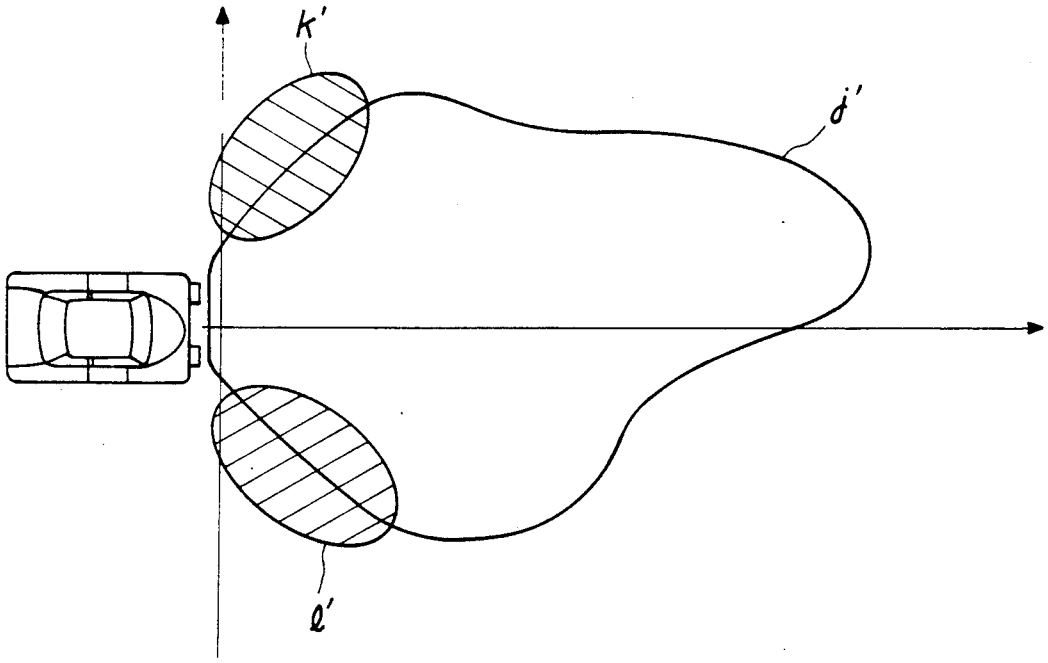
FIG. 33 PRIOR ART
FIG. 33 is a plan view of the pattern of FIG. 32.
Figure 34:
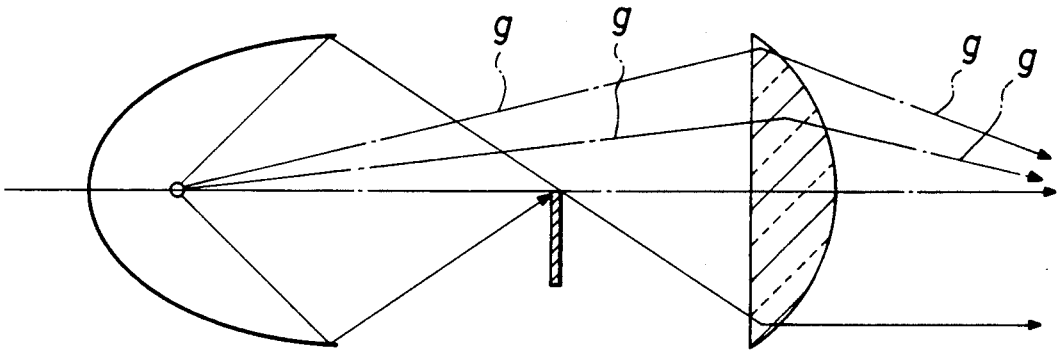
FIG. 34 PRIOR ART
FIG. 34 is a schematic view similar to FIG. 31 but showing the diffusion of light rays.
Figure 35:
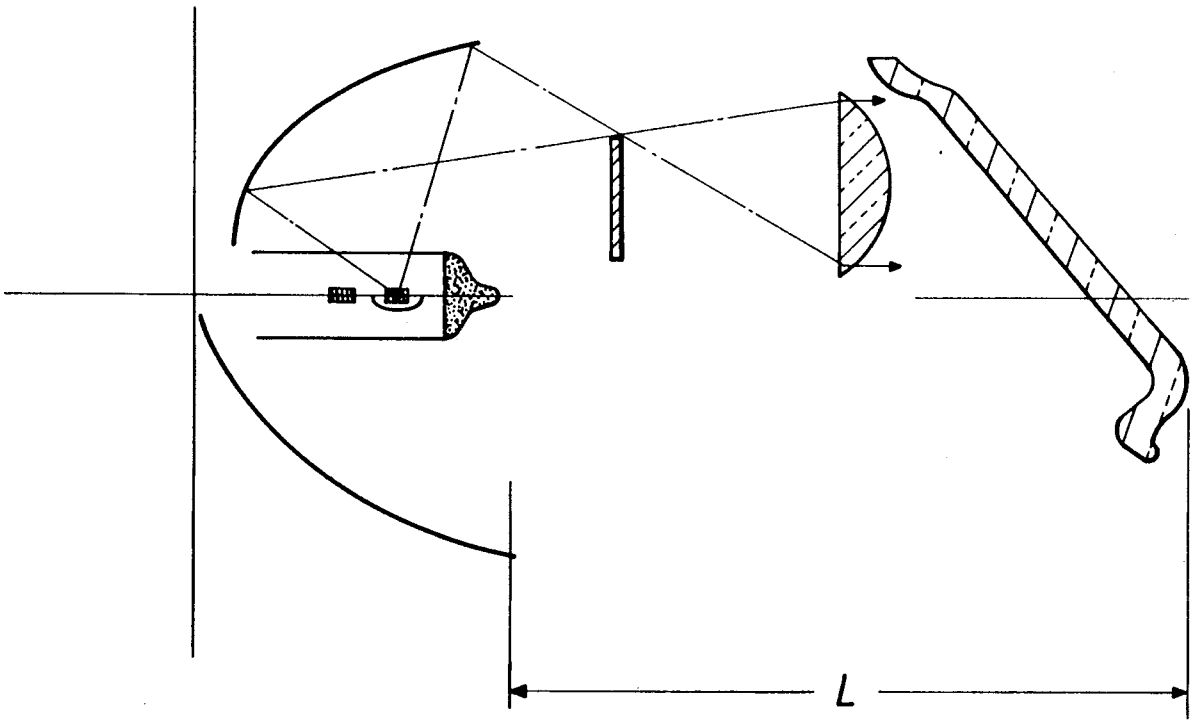
FIG. 35 PRIOR ART
FIG. 35 is a schematic view of another example of prior art automotive projector type headlight.
Figure 36:
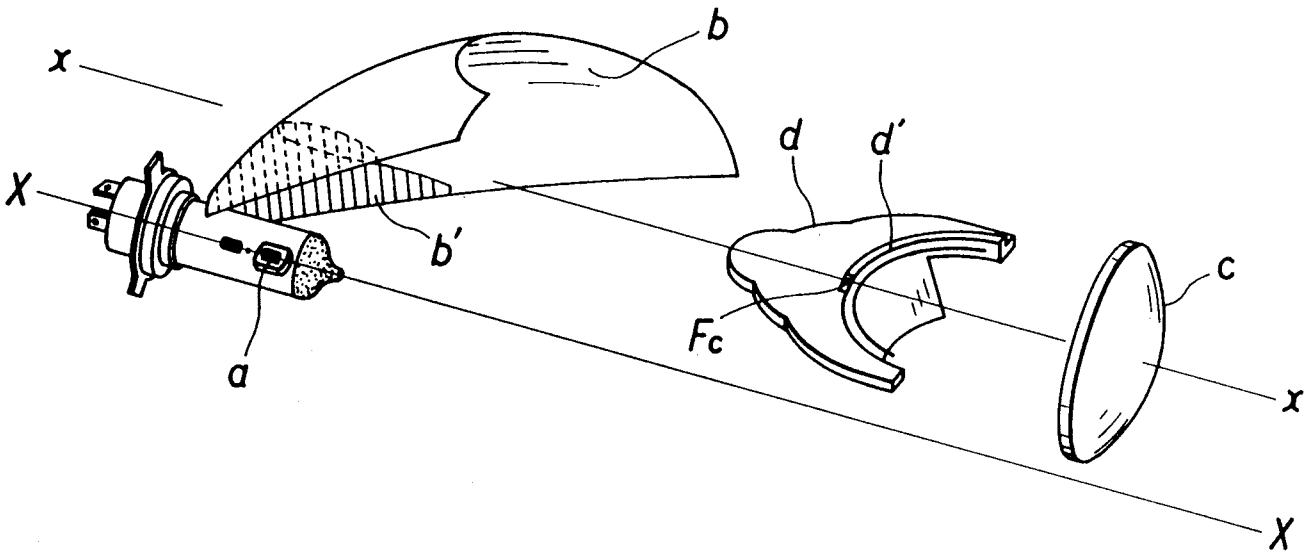
FIG. 36 PRIOR ART
FIG. 36 is a schematic perspective view of a further example of prior art automotive projector type headlight.
Figure 37:
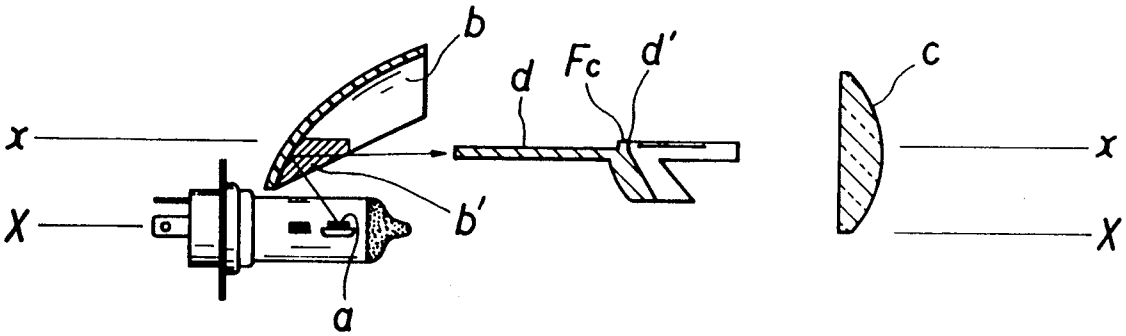
FIG. 37 PRIOR ART
FIG. 37 is a longitudinal sectional view of FIG. 36.
Figure 38:
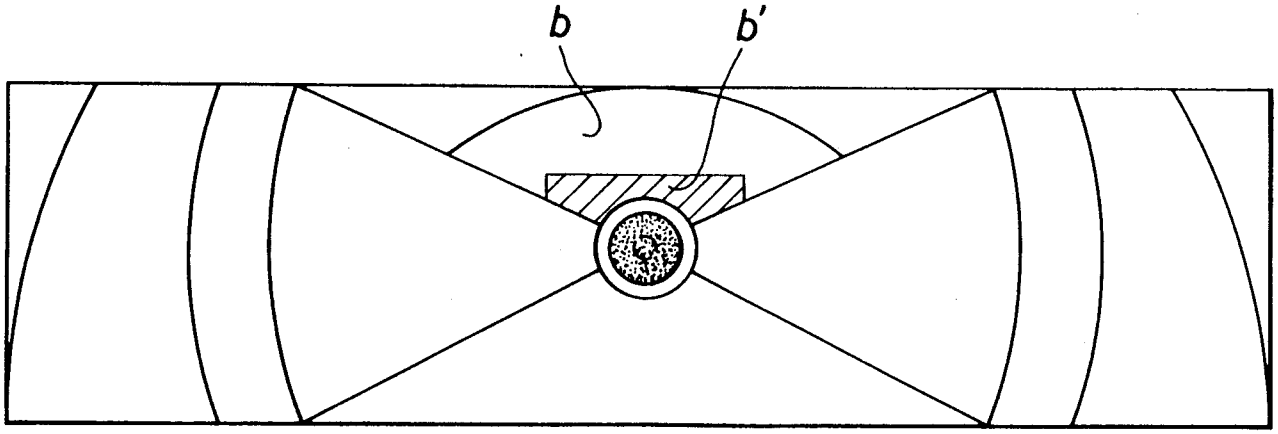
FIG. 38 PRIOR ART
FIG. 38 is a front view of the headlight of FIG. 36.

FIGS. 28 through 30 show a modified embodiment of diffusing and reflecting portion according to the present invention.

A diffusing and reflecting portion 265 of the upper reflective surface 213 consists of left and right portions 266 and 267 of the surface of parabola.

The focus of the portions 266 and 267 are on the focus $F_{13}$ of the upper reflective surface 213. The optical axis $x_l$—$x_l$ of the left (as viewed from the rear) portion 266 is inclined left and forward direction, and the optical axis $x_r$—$x_r$ of the right portion 267 is inclined right and forward direction. The inclination of these optical axis may be inversed. Further, in the embodiment, these optical axis are inclined downward and forward, but the optical axis may be parallel to the optical axis X—X of the headlight 201.

In providing the diffusing and reflecting portion 265 the light beam due to the light rays emitted from the sub-filament 210 and reflected on the portions 266 and 267 are, as shown at numerals 268 and 269 in FIG. 28, located further outside from left and right lower edges of the pattern 240, thus, the shoulder portions of the lane can further be illuminated.

Advantages of the Invention

As described heretofore, according to the invention, it is possible to obtain a sufficient amount of light beam from an automotive headlight having a reduced size in the vertical directions, to reduce the effect of the cover lens to the minimum thereby a largely inclined cover lens can be utilized which is advantageous in the design of the automobile. Further, it is possible to illuminate sufficiently the nearest portions of the lane including the shoulder portions. Further, the light rays shaded by the shade member can be utilized effectively.

It will be understood that the embodiments described as above are well calculated to fulfill the objects of the invention, but various changes and modifications may be devised by those skilled in the art within the scope of the present invention. For example, the detailed construction or the shape is a simple exemplification and may be modified as desired.

I claim:

1. An automotive projector type headlight including a light source, a reflector for reflecting light from said light source and converging it to a converging position, a shade for partially shading and contouring the reflected light, and a projecting lens for projecting the contoured light forward, wherein the shade is a generally horizontally disposed plate with a lower surface thereof being formed as a reflective surface, and which reflective surface acts to reflect light rays from the light source and to project them forward and downward.

2. An automotive projector type headlight including a light source, a reflector for reflecting light from said light source forward, a shade for partially shading and contouring the reflected light, and a projecting lens for projecting the contoured light forward, wherein the light source comprises a main filament and a sub-filament extending generally along an optical axis of said light source, the reflector comprises a plurality of radially divided reflective surface portions, with an upper surface portion reflecting light from the sub-filament and converging it to a first converging position located above said optical axis, the shade has a shading edge near to the first converging position, a focus of the projecting lens is near to the shading edge, a lower reflective surface portion reflects light from the main filament, converges it to a horizontally extending second converging position and converges it to a vertically extending third converging position, left and right inner reflective surface portions converge and diffuse thereafter light from both filaments in left and right directions, and left and right outer reflective surface portions are paraboloid of rotation having the focus near to the filaments.

3. An automotive projector type headlight including a light source, a reflector for reflecting light from said light source forward, a shade for partially shading and contouring the reflected light, and a projecting lens for projecting the contoured light forward, wherein the shade is a generally horizontally disposed plate with a lower surface thereof being formed as a reflective surface, and which reflective surface acts to reflect light rays reflected on the reflective surface and to project them forward and downward.

4. An automotive projector type headlight including a light source, a reflector for reflecting light from said light source forward, a shade for partially shading and contouring the reflected light, and a projecting lens for projecting the contoured light forward, wherein a portion of the reflector located below the shade is formed as a diffusing and reflecting portion for reflecting light so as to diffuse in a horizontal direction and to direct the light reflected by said portion parallel to an optical axis of said headlight in a vertical direction.

5. An automotive projector type headlight according to claim 4, wherein the diffusing and reflecting portion is a parabola in vertical section and an ellipse in horizontal section.

6. An automotive projector type headlight according to claim 4, wherein the diffusing and reflecting portion is formed of left and right paraboloid portions with an optical axis of each portion being parallel to the optical axis of the headlight in vertical sectional view and inclined relative thereto in plan view.

7. An automotive projector type headlight according to claim 4, wherein the diffusing and reflecting portion is formed of left and right paraboloid portions with an optical axis of each portion being parallel to the optical axis of the headlight in vertical sectional view and inclined relative thereto in plan view.

8. An automotive projector type headlight including a light source, a reflector for reflecting the light forward, a shade for partially shading and contouring the reflected light, and a projecting lens for projecting the contoured light forward, an optical axis of said lens extending parallel and above a optical axis of said headlight wherein a portion of the reflector located below the shade and above said optical axis of said headlight is formed as a diffusing and reflecting portion for reflecting light so as to diffuse in a horizontal direction and to direct the light reflected by said portion downward of the optical axis of said headlight a vertical direction.

9. An automotive projector type headlight according to claim 8, wherein the diffusing and reflecting portion is a parabola in vertical section and an ellipse in horizontal section.

10. An automotive projector type headlight according to claim 8, wherein the diffusing and reflecting portion is formed of left and right paraboloid portions with an optical axis of each portion inclined forward and downward relative to the optical axis of the headlight in vertical sectional view and inclined relative thereto in plan view.

11. An automotive projector type headlight according to claim 8, wherein the diffusing and reflecting portion is formed of left and right paraboloid portions with an optical axis of each portion inclined forward and downward relative to the optical axis of the headlight in vertical sectional view and inclined relative thereto in plan view.

* * * * *